US007883404B2

(12) United States Patent
Okada

(10) Patent No.: US 7,883,404 B2
(45) Date of Patent: Feb. 8, 2011

(54) SLOT MACHINE WITH USER SELECTABLE ACCUMULATIVE HOLD SYMBOLS AND PLAYING METHOD THEREOF

(75) Inventor: Kazuo Okada, Tokyo (JP)

(73) Assignee: Aruze Gaming America, Inc., Las Vegas, NV (US)

( * ) Notice: Subject to any disclaimer, the term of this patent is extended or adjusted under 35 U.S.C. 154(b) by 857 days.

(21) Appl. No.: 11/790,186

(22) Filed: Apr. 24, 2007

(65) Prior Publication Data

US 2008/0064464 A1 Mar. 13, 2008

Related U.S. Application Data

(60) Provisional application No. 60/844,121, filed on Sep. 13, 2006.

(51) Int. Cl.
*A63F 9/24* (2006.01)

(52) U.S. Cl. ..... 463/16; 463/13; 463/20

(58) Field of Classification Search ..... 463/13, 463/16, 20

See application file for complete search history.

(56) References Cited

U.S. PATENT DOCUMENTS

| | | | | |
|---|---|---|---|---|
| 5,033,744 | A * | 7/1991 | Bridgeman et al. | 463/13 |
| 6,093,102 | A | 7/2000 | Bennett | |
| 6,604,999 | B2 | 8/2003 | Ainsworth | |
| 6,935,947 | B1 | 8/2005 | Singer et al. | |
| 7,419,424 | B2 * | 9/2008 | Gomez | 463/13 |
| 2004/0092300 | A1 | 5/2004 | Gauselmann | |
| 2005/0288090 | A1 | 12/2005 | Thomas et al. | |
| 2006/0172795 | A1 | 8/2006 | Bussick et al. | |
| 2008/0064464 | A1 | 3/2008 | Okada | |

FOREIGN PATENT DOCUMENTS

CN 1145260 A 3/1997

OTHER PUBLICATIONS

International Search Report, Macao; Jan. 5, 2009, English translation included.

* cited by examiner

*Primary Examiner*—James S McClellan
*Assistant Examiner*—Lawrence Galka
(74) *Attorney, Agent, or Firm*—NDQ&M Watchstone LLP

(57) ABSTRACT

The slot machine fixes symbols selected by the player's operation to press a touch panel and symbols next to selected symbols which coincide with selected symbols, and scrolls symbols other than fixed symbols.

7 Claims, 23 Drawing Sheets

FIG. 4

| CODE NO. | SYMBOL | CODE NO. | SYMBOL |
|---|---|---|---|
| 00 | JACK 7 POT (JACKPOT 7) | 05 | (CHERRY) |
| 01 | (PLUM) | 06 | (ORANGE) |
| 02 | (LOBSTER) | 07 | (STRAWBERRY) |
| 03 | (CRAB) | 08 | (APPLE) |
| 04 | (BELL) | 09 | (BLUE 7) |

| STOPPED SYMBOLS | NUMBER OF STOPPED SYMBOLS | PAYOUT AMOUNT |
|---|---|---|
| PLUM | 10 OR MORE | 2 * BET NUMBER |
| APPLE | 8 OR MORE | 3 * BET NUMBER |
| LOBSTER | 5 OR MORE | 5 * BET NUMBER |
| CRAB | 3 OR MORE | 6 * BET NUMBER |

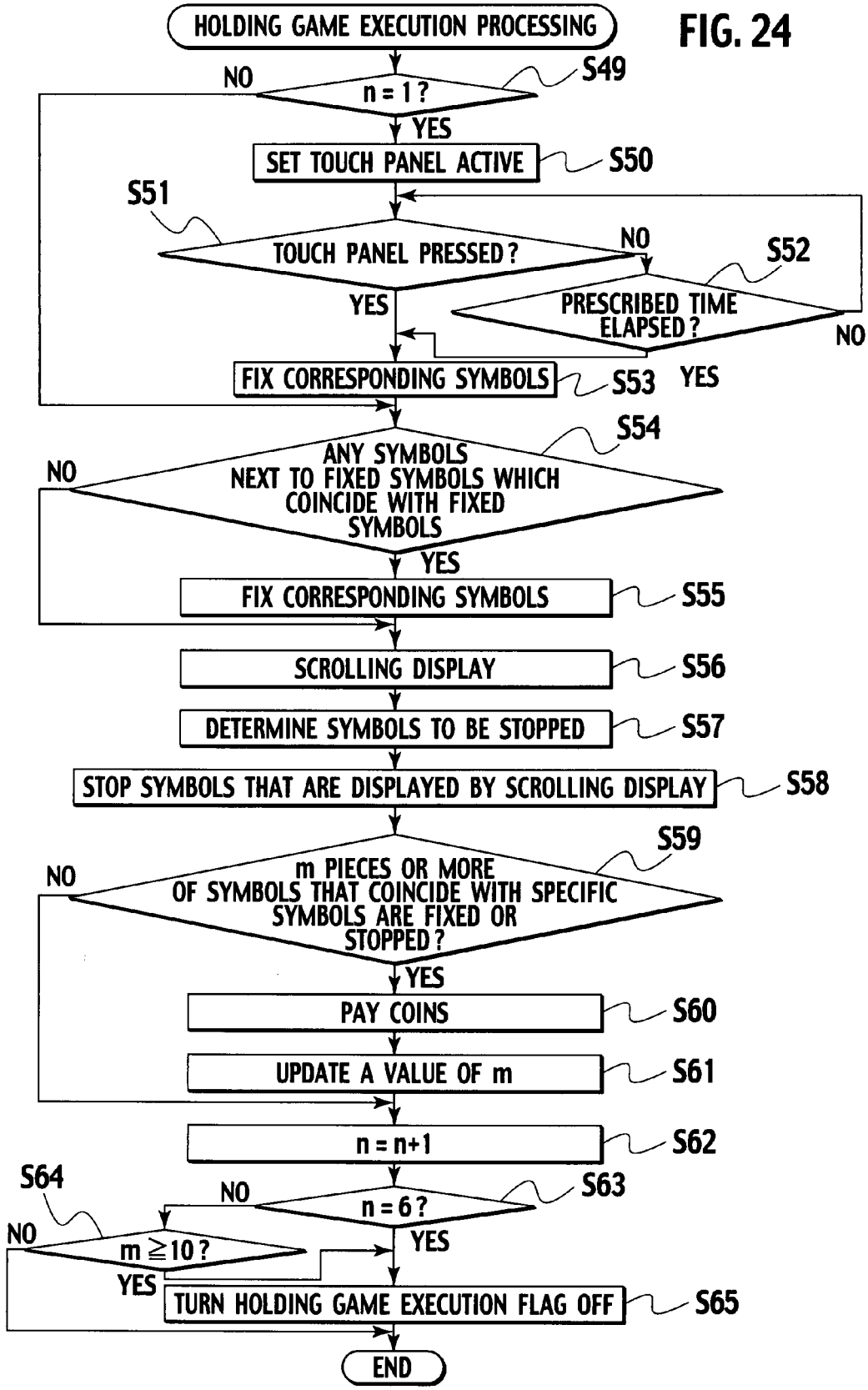
HOLDING GAME EXECUTION PROCESSING
FIG. 24
n = 1 ?
S49
NO
YES
SET TOUCH PANEL ACTIVE
S50
S51
TOUCH PANEL PRESSED ?
NO
S52
YES
PRESCRIBED TIME ELAPSED ?
NO
FIX CORRESPONDING SYMBOLS
S53
YES
S54
ANY SYMBOLS NEXT TO FIXED SYMBOLS WHICH COINCIDE WITH FIXED SYMBOLS
NO
YES
FIX CORRESPONDING SYMBOLS
S55
SCROLLING DISPLAY
S56
DETERMINE SYMBOLS TO BE STOPPED
S57
STOP SYMBOLS THAT ARE DISPLAYED BY SCROLLING DISPLAY
S58
S59
m PIECES OR MORE OF SYMBOLS THAT COINCIDE WITH SPECIFIC SYMBOLS ARE FIXED OR STOPPED ?
NO
YES
PAY COINS
S60
UPDATE A VALUE OF m
S61
n = n+1
S62
S64
NO
n = 6 ?
S63
NO
m ≧10 ?
YES
YES
TURN HOLDING GAME EXECUTION FLAG OFF
S65
END

SLOT MACHINE WITH USER SELECTABLE ACCUMULATIVE HOLD SYMBOLS AND PLAYING METHOD THEREOF

CROSS REFERENCE TO RELATED APPLICATION

This application claims priority to U.S. provisional patent application Ser. No. 60/844,121 entitled "SLOT MACHINE AND PLAYING METHOD THEREOF" filed on Sep. 13, 2006 and naming Kazuo OKADA as inventor, and which is incorporated by reference herein for all purposes.

BACKGROUND OF THE INVENTION

1. Field of the Invention

The present invention relates to a slot machine for playing games by using a game medium such as coin or bill, and a playing method thereof.

2. Description of the Related Art

As the conventional slot machine, as disclosed in U.S. Pat. No. 6,604,999B2, there are those which make a payout with respect to having a winning combination rearranged on a payline of a display or having a prescribed number or more of prescribed symbols rearranged on a display.

Also, in U.S. Pat. No. 6,093,102A, there is discloses a slot machine which makes a payout in the case where a winning combination is rearranged on a payline which comes in patterns that can be increased by a player's selection.

SUMMARY OF THE INVENTION

The first aspect of the present invention is a slot machine, comprising: a display for automatically arranging or rearranging a plurality of symbols; a controller for executing a base game for automatically rearranging the plurality of symbols that are arranged on the display; and a control input signal switch capable of carrying out a selection operation to select symbols rearranged by the base game; wherein the controller executes a holding game for fixing symbols selected by the selection operation and symbols next to symbols selected by the selection operation which coincide with symbols selected by the selection operation among symbols rearranged by the base game, and rearranging symbols other than fixed symbols among symbols rearranged by the base game.

The slot machine of the first aspect of the present invention executes a holding game for fixing symbols selected by the selection operation and symbols next to symbols selected by the selection operation which coincide with symbols selected by the selection operation among symbols rearranged by the base game, and rearranging symbols other than fixed symbols among symbols rearranged by the base game.

The second aspect of the present invention is a slot machine, comprising: a display for automatically arranging or rearranging a plurality of symbols; a controller for executing a base game for automatically rearranging the plurality of symbols that are arranged on the display; and a control input signal switch capable of carrying out a selection operation to select symbols rearranged by the The slot machine of the second aspect of the present invention executes the first holding game and the second and subsequent holding games. In the first holding game, symbols selected by the selection operation and symbols next to symbols selected by the selection operation which coincide with symbols selected by the selection operation among symbols rearranged by the base game are fixed. In addition, symbols other than fixed symbols among symbols rearranged by the base game are rearranged. In the second and subsequent holding games, symbols fixed by a previous holding game and symbols next to symbols fixed by the previous holding game which coincide with symbols fixed by the previous holding game among symbols rearranged by the previous holding game are fixed. In addition, symbols other than fixed symbols among symbols rearranged by the previous holding game are rearranged.

The third aspect of the present invention is a slot machine, comprising: a display for automatically arranging or rearranging a plurality of symbols; a controller for executing a base game for automatically rearranging the plurality of symbols that are arranged on the display; and a control input signal switch capable of carrying out a selection operation to select symbols rearranged by the base game; wherein the controller judges whether or not to make a payout of credits according to symbols rearranged by the base game, and in a case where it is judged that a payout of credits is not to be made, the controller executes a first holding game for fixing symbols selected by the selection operation and symbols next to symbols selected by the selection operation which coincide with symbols selected by the selection operation among symbols rearranged by the base game, and rearranging symbols other than fixed symbols among symbols rearranged by the base game, and second and subsequent holding games for fixing symbols fixed by a previous holding game and symbols next to symbols fixed by the previous holding game which coincide with symbols fixed by the previous holding game among symbols rearranged by the previous holding game, and rearranging symbols other than fixed symbols among symbols rearranged by the previous holding game.

The slot machine of the third aspect of the present invention judges whether or not to make a payout of credits according to symbols rearranged by the base game, and in a case where it is judged that a payout of credits is not to be made, executes a first holding game and the second and subsequent holding games. In the first holding game, symbols selected by the selection operation and symbols next to symbols selected by the selection operation which coincide with symbols selected by the selection operation among symbols rearranged by the base game are fixed. In addition, symbols other than fixed symbols among symbols rearranged by the base game are rearranged. In the second and subsequent holding games, symbols fixed by a previous holding game and symbols next to symbols fixed by the previous holding game which coincide with symbols fixed by the previous holding game among symbols rearranged by the previous holding game are fixed. In addition, symbols other than fixed symbols among symbols rearranged by the previous holding game are rearranged.

The fourth aspect of the present invention is a playing method of a slot machine, comprising the steps of: executing a base game for automatically rearranging a plurality of symbols that are arranged on a display; and executing a holding game for fixing symbols selected by a selection operation using a control input signal switch capable of carrying out a selection operation to select symbols rearranged by the base game, and symbols next to symbols selected by the selection operation which coincide with symbols selected by the selection operation among symbols rearranged by the base game, and rearranging symbols other than fixed symbols among symbols rearranged by the base game.

In the playing method of a slot machine of the fourth aspect of the present invention, a holding game for fixing symbols selected by the selection operation and symbols next to symbols selected by the selection operation which coincide with symbols selected by the selection operation among symbols rearranged by the base game, and rearranging symbols other than fixed symbols among symbols rearranged by the base game is executed.

The fifth aspect of the present invention is a playing method of a slot machine, comprising the steps of: executing a base game for automatically rearranging a plurality of symbols that are arranged on a display; executing a first holding game for fixing symbols selected by a selection operation using a control input signal switch capable of carrying out a selection operation to select symbols rearranged by the base game, and symbols next to symbols selected by the selection operation which coincide with symbols selected by the selection operation among symbols rearranged by the base game, and rearranging symbols other than fixed symbols among symbols rearranged by the base game; and executing second and subsequent holding games for fixing symbols fixed by a previous holding game and symbols next to symbols fixed by the previous holding game which coincide with symbols fixed by the previous holding game among symbols rearranged by the previous holding game, and rearranging symbols other than fixed symbols among symbols rearranged by the previous holding game.

In the playing method of a slot machine of the fifth aspect of the present invention, the first holding game and the second and subsequent holding games are executed. In the first holding game, symbols selected by the selection operation and symbols next to symbols selected by the selection operation which coincide with symbols selected by the selection operation among symbols rearranged by the base game are fixed. In addition, symbols other than fixed symbols among symbols rearranged by the base game are rearranged. In the second and subsequent holding games, symbols fixed by a previous holding game and symbols next to symbols fixed by the previous holding game which coincide with symbols fixed by the previous holding game among symbols rearranged by the previous holding game are fixed. In addition, symbols other than fixed symbols among symbols rearranged by the previous holding game are rearranged.

The sixth aspect of the present invention is a playing method of a slot machine, comprising the steps of: executing a base game for automatically rearranging a plurality of symbols that are arranged on a display; judging whether or not to make a payout of credits according to symbols rearranged by the base game, and in a case where it is judged that a payout of credits is not to be made, executing a first holding game for fixing symbols selected by a selection operation using a control input signal switch capable of carrying out a selection operation to select symbols rearranged by the base game, and symbols next to symbols selected by the selection operation which coincide with symbols selected by the selection operation among symbols rearranged by the base game, and rearranging symbols other than fixed symbols among symbols rearranged by the base game; and executing second and subsequent holding games for fixing symbols fixed by a previous holding game and symbols next to symbols fixed by the previous holding game which coincide with symbols fixed by the previous holding game among symbols rearranged by the previous holding game, and rearranging symbols other than fixed symbols among symbols rearranged by the previous holding game.

In the playing method of a slot machine of the sixth aspect of the present invention, whether or not to make a payout of credits according to symbols rearranged by the base game is judged, and in a case where it is judged that a payout of credits is not to be made, a first holding game and the second and subsequent holding games are executed. In the first holding game, symbols selected by the selection operation and symbols next to symbols selected by the selection operation which coincide with symbols selected by the selection operation among symbols rearranged by the base game are fixed. In addition, symbols other than fixed symbols among symbols rearranged by the base game are rearranged. In the second and subsequent holding games, symbols fixed by a previous holding game and symbols next to symbols fixed by the previous holding game which coincide with symbols fixed by the previous holding game among symbols rearranged by the previous holding game are fixed. In addition, symbols other than fixed symbols among symbols rearranged by the previous holding game are rearranged.

The seventh aspect of the present invention is a slot machine, having a controller for executing a base game for automatically rearranging a plurality of symbols that are arranged on a display, and executing a holding game for fixing symbols selected by a selection operation using a control input signal switch capable of carrying out a selection operation to select symbols rearranged by the base game, and symbols next to symbols selected by the selection operation which coincide with symbols selected by the selection operation among symbols rearranged by the base game, and rearranging symbols other than fixed symbols among symbols rearranged by the base game.

The slot machine of the seventh aspect of the present invention executes a holding game for fixing symbols selected by the selection operation and symbols next to symbols selected by the selection operation which coincide with symbols selected by the selection operation among symbols rearranged by the base game, and rearranging symbols other than fixed symbols among symbols rearranged by the base game.

BRIEF DESCRIPTION OF THE DRAWINGS

FIG. 4 is a diagram showing symbols and code numbers of the symbols displayed in the slot machine according to the first embodiment of the present invention.

FIG. 24 is a flow chart showing a procedure of a holding game execution processing to be executed by the slot machine according to the second embodiment of the present invention.

DETAILED DESCRIPTION OF THE EMBODIMENT

First Embodiment

Figure 1:
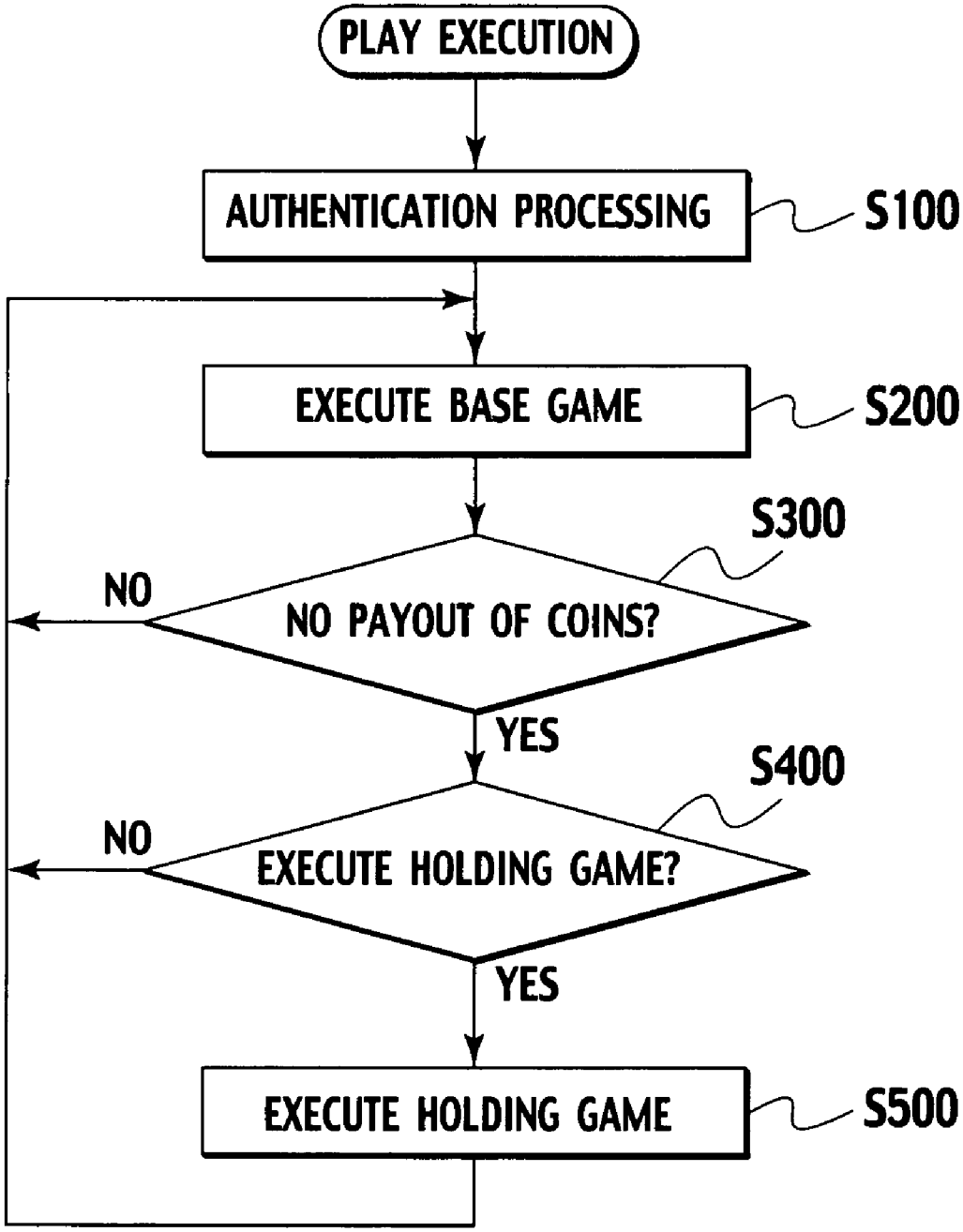
FIG. 1 is a flow chart showing a playing method of a slot machine according to a first embodiment of the present invention.

FIG. 1 is a flow chart schematically showing a playing method of a slot machine according to the first embodiment of the present invention. The schematic operations in the slot machine 10 according to the first embodiment of the present invention will be described below, with reference to the flow chart shown in FIG. 1, a diagram shown in FIG. 2, a diagram of display regions shown in FIG. 3, a block diagram shown in FIG. 5, and diagrams shown in FIG. 11 and FIG. 12. Note that the slot machine 10 is a stand-alone type slot machine that is not connected to a network, but the present invention is applicable to a slot machine connected to a network as well.

In the slot machine 10 according to the first embodiment of the present invention, when the power is turned on and the slot machine 10 is activated, an authentication processing is carried out at the step S100. In this authentication processing, the initial checking processing such as whether a program for operating the system is operating normally or not, whether there is any alteration of a program or not, etc., is carried out. More specifically, the following processing is carried out. Here, it is assumed that a memory card 53 is attached to a card slot 53S and a GAL 54 is attached to an IC socket 54S on a gaming board 50.

First, when the power switch is turned on at the power source unit 45, a mother board 40 and the gaming board 50 are activated. On the gaming board 50, a CPU 51 reads out a spare authentication program stored in a boot ROM 52, and carries out a spare authentication for checking and verifying that an authentication program is not altered in advance, before it is taken into the mother board 40, according to that read out spare authentication program.

On the other hand, on the mother board 40, a main CPU 41 executes a BIOS (Basic Input/Output System) stored in a ROM 42, and develops compressed data incorporated into the BIOS on a RAM 43. Then, the main CPU 41 executes the BIOS developed on the RAM 43 and carries out a diagnosis and an initialization of various peripheral devices.

The main CPU 41 reads out an authentication program stored in a ROM 55 and stores it into the RAM 43. Next, the main CPU 41 reads out a game program and a game system program stored in the memory card 53. Next, the main CPU 41 carries out an authentication for checking and verifying that the read out game program and game system program are not altered, according to the authentication program stored in the RAM 43.

When this authentication processing is finished normally, the main CPU 41 stores the authenticated game program and game system program into the RAM 43. Next, the main CPU 41 reads payout rate setting data from the GAL (Generic Array Logic) 54, and stores them into the RAM 43. Next, the main CPU 41 reads out country identification information stored in the ROM 55 of the gaming board 50 through a PCI bus, and stores the read out country identification information into the RAM 43. By the above, the processing of the step S100 is finished.

Figure 11:
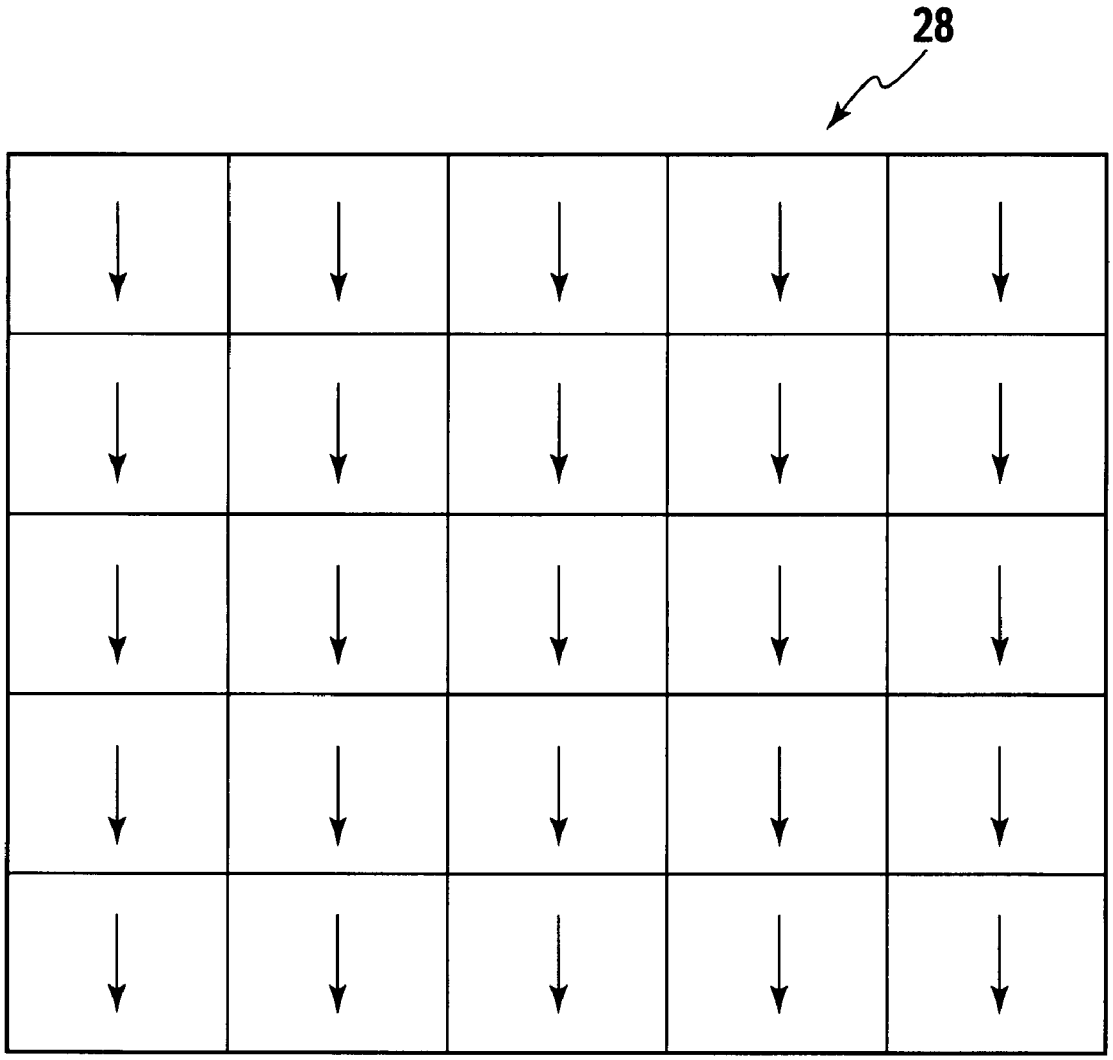
FIG. 11 is a diagram showing one example of symbols to be scrolled in the slot machine according to the first embodiment of the present invention.
Figure 12:
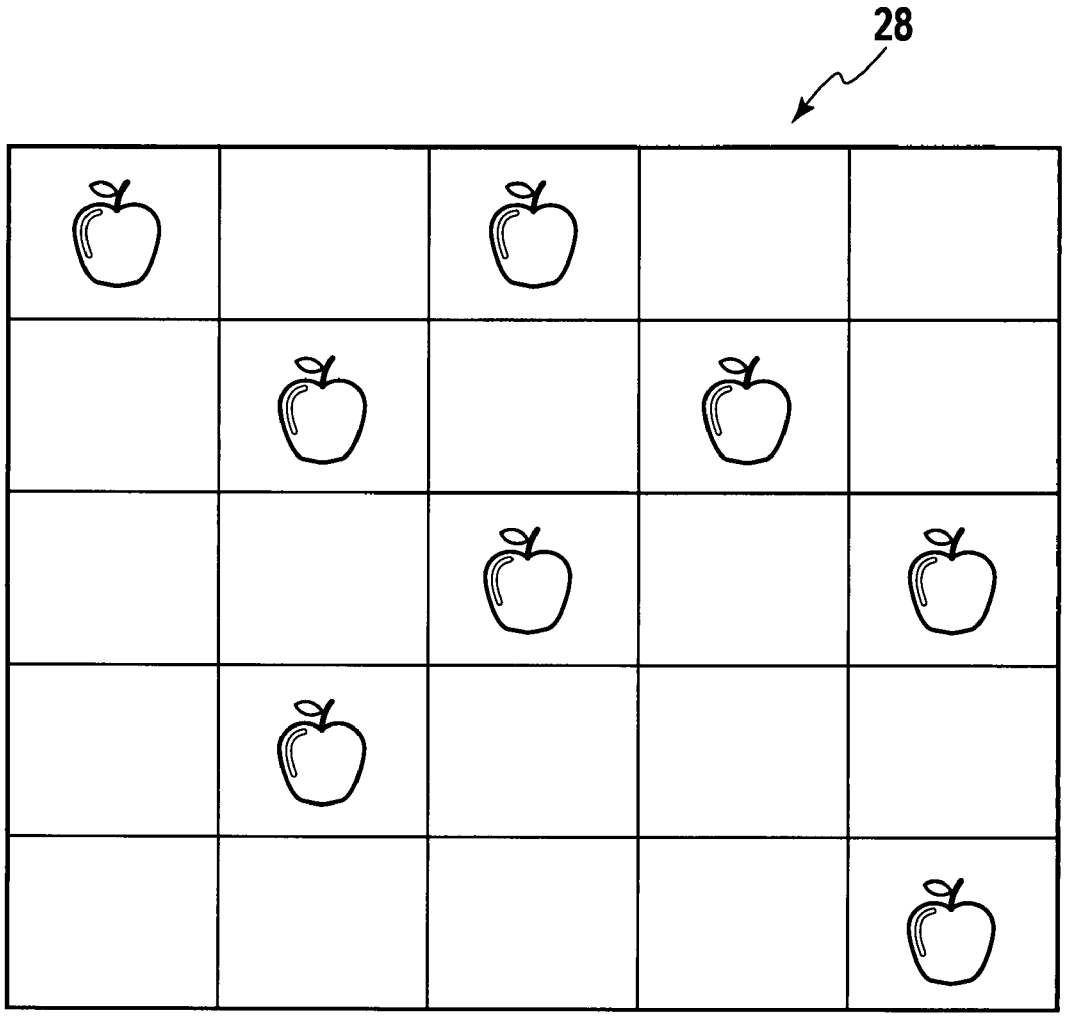
FIG. 12 is a diagram showing one example of symbols to be rearranged in the slot machine according to the first embodiment of the present invention.

At the step S200, the slot machine 10 executes a base game. In the base game, symbols stopped (that is, arranged) in the display regions 28*a*1 to 28*e*5 are scrolled in the display regions 28*a*1 to 28*e*5 as shown in FIG. 11, and automatically stopped (that is, automatically rearranged) as shown in FIG. 12. Note that, in FIG. 12, symbols other than "APPLE" are omitted. Namely, the display regions 28 of a liquid crystal display 17 are divided into the display regions 28*a*1 to 28*e*5, and symbols are scrolled and stopped in the display regions 28*a*1 to 28*e*5. Symbols to be scrolled and stopped in the display regions 28*a*1 to 28*e*5 are visible to a player through a display window 15. Consequently, the display comprises the display window 15 and the liquid crystal display 17. A payout of coins will be made according to a combination of symbols stopped.

At the step S300, the slot machine 10 determines whether or not to make a payout of coins according to a result of the base game, and in a case where it is determined that a payout of coins is to be made, the processing proceeds to the step S200, whereas in a case where it is determined that a payout of coins is not to be made, the processing proceeds to the step S400.

At the step S400, the slot machine 10 determines whether or not to execute a holding game, and in a case where it is determined that a holding game is to be executed, the processing proceeds to the step S500, whereas in a case where it is determined that a holding game is not to be executed, the processing proceeds to the step S200.

At the step S500, the slot machine 10 executes the holding game. After that, the slot machine 10 returns to the step S200. The holding game is executed for a plurality of times. In the first holding game, symbols selected by a pressing operation (that is, a selection operation) of the touch panel 69 and symbols next to symbols selected by the pressing operation of the touch panel 69 from any of up, down, left and right directions and which coincide with symbols selected by the pressing operation of the touch panel 69 will be fixed among symbols stopped by the base game. After that, symbols other than the fixed symbols among symbols stopped by the base game will be scrolled and then automatically stopped. In the second and subsequent holding games, symbols fixed by the previous holding game and symbols next to the symbols fixed by the previous holding game from any of up, down, left and right directions and which coincide with symbols fixed by the previous holding game will be fixed among symbols stopped by the previous holding game. After that, symbols other than the fixed symbols among symbols stopped by the previous holding game will be scrolled and then automatically stopped.

In the above described example, the case of stopping and displaying symbols in the display regions 28*a*1 to 28*e*5 has been described, but the present invention is not limited to this case. Namely, it is also possible to use a configuration using cylindrically shaped mechanical rotation reels which have a plurality of symbols displayed on their side faces, in which these rotation reels are rotated and then stopped such that symbols are stopped inside the display window 15.

Next, a configuration of the slot machine 10 according to the first embodiment of the present invention will be described with reference to a diagram shown in FIG. 2. This slot machine 10 is provided within a gaming facility.

In the slot machine 10, the coins, bills or tickets with bar codes 39 corresponding to these will be used as the game medium for executing the base game or the holding game. However, the game medium that can be used in the present invention is not limited to these, and can be medals, tokens, electronic money, or tickets, for example.

Figure 2:
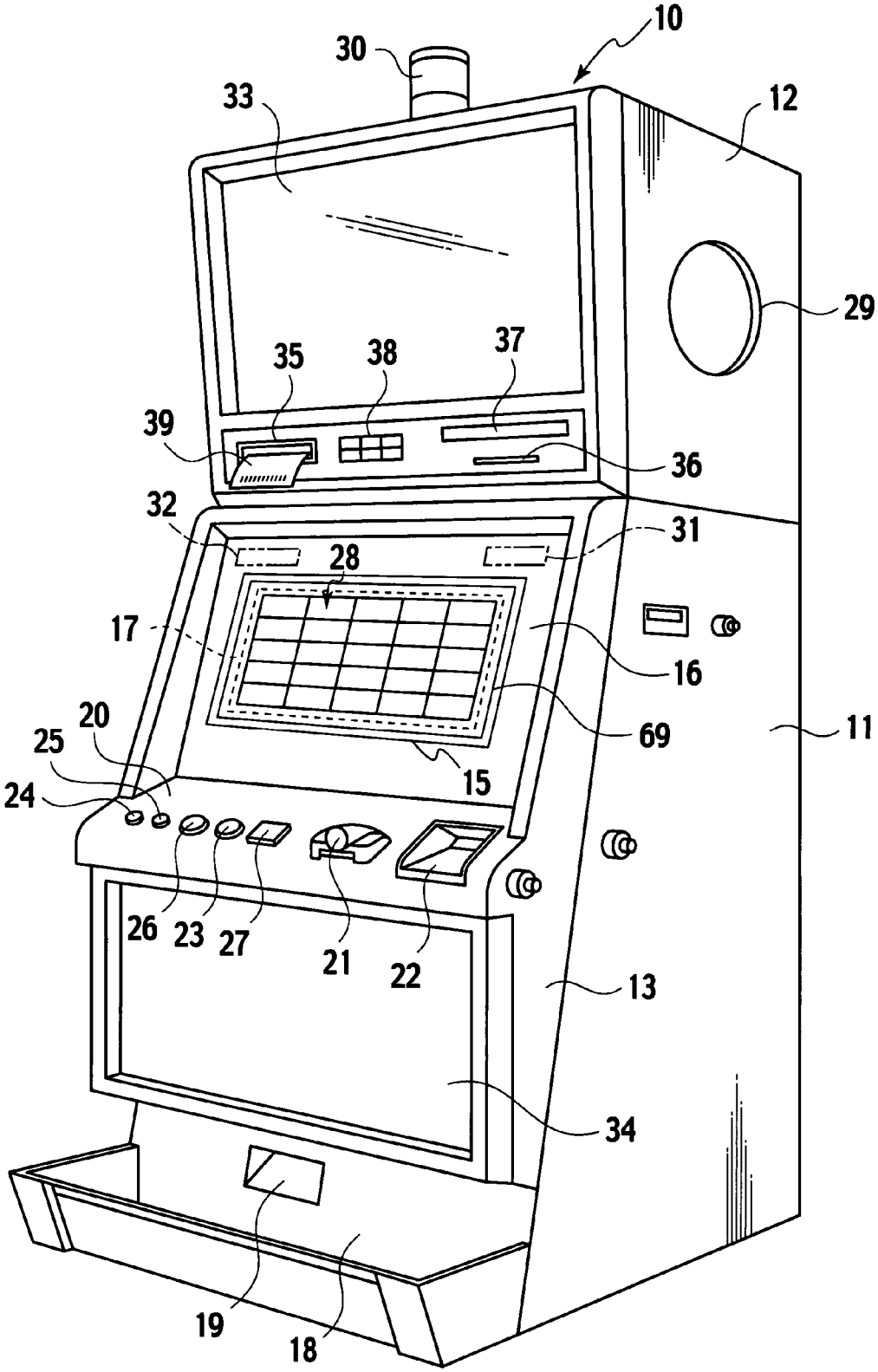
FIG. 2 is a diagram showing an outward appearance of the slot machine according to the first embodiment of the present invention.

As shown in FIG. 2, the slot machine 10 has a cabinet (casing) 11, a top box 12 provided on an upper side of the cabinet 11, and a main door 13 provided on a front side of the cabinet 11.

On the main door 13, a lower side image display panel 16 is provided. The lower side image display panel 16 has a transparent liquid crystal panel, on which various information regarding the game and the effect images will be displayed during the game.

Figure 3:
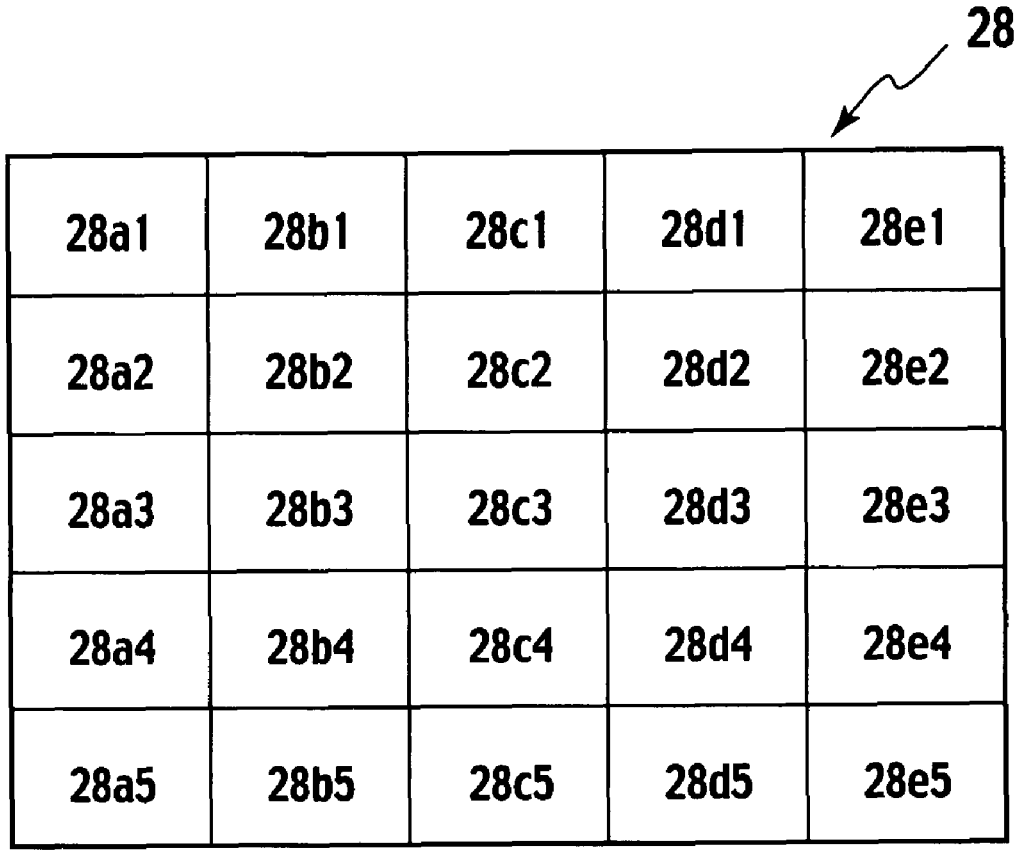
FIG. 3 is a diagram showing display regions of the slot machine according to the first embodiment of the present invention.

The lower side image display panel 16 has the display window 15. On a back side of the display window 15, the liquid crystal display 17 is provided. The display regions 28 of the liquid crystal display 17 are divided into the display regions 28*a*1 to 28*e*5 as shown in FIG. 3. The liquid crystal display 17 scrolls a symbol sequence in each one of the display regions 28*a*1 to 28*e*5. In this way, the liquid crystal display 17 scrolls symbols in each one of the display regions 28*a*1 to 28*e*5. Each symbol sequence is formed by combining a plurality of symbols shown in FIG. 4, and symbol sequences are different from each other. Each of symbols constituting each symbol sequence is assigned with one of code numbers 00 to 09. For example, the code number "00" is assigned to the symbol "JACKPOT7". Note that letters within parentheses in FIG. 4 indicate a name of the symbol. The liquid crystal display 17 scrolls symbols in the display regions 28*a*1 to 28*e*5 and then stops symbols in the display regions 28*a*1 to 28*e*5. Symbols to be scrolled and stopped in the display regions 28*a*1 to 28*e*5 are visible to the player through the display window 15.

Note that, in the first embodiment and the second embodiment to be described below, symbols are displayed by using the liquid crystal display 17, but it is also possible to provide a plurality of mechanical reels instead of the liquid crystal display 17 and display symbols by using these mechanical reels.

On a front face of the display window 15, the touch panel 69 (control input signal switch) is provided. The touch panel 69 is provided such that it faces against the entire display regions 28. When any portion of the touch panel 69 is pressed by the player, the touch panel 69 outputs a control input signal corresponding to the pressed portion to the main CPU 41 (see FIG. 5).

On the lower side image display panel 16, a credit amount display unit 31 and a payout amount display unit 32 are provided. The credit amount display unit 31 displays a total amount of coins that can be paid to the player by the slot machine 10 (hereinafter referred also as "total credit amount"). The total credit amount is stored in the RAM 43 to be described below. The payout amount display unit 32 displays a number of coins to be paid in the case where a prescribe number of prescribed symbols are stopped in the base game or the holding game. Note that the prescribed number and the prescribed symbols are predetermined in the base game, and the prescribed symbols can be arbitrarily selected by the player in the holding game. The prescribed number becomes three or more in the holding game. These features will be described below.

On a lower side of the lower side image display panel 16, a control panel 20 having a plurality of buttons 23 to 27 through which commands regarding the progress of the game will be inputted by the player, a coin slot 21 for receiving coins into the cabinet 11, and a bill validator 22 are provided.

On the control panel 20, a spin button 23, a change button 24, a cashout button 25, a 1-BET button 26, and a Max-BET button 27 are provided. The spin button 23 is a button for inputting a command for starting the scrolling display of symbols. The change button 24 is a button to be used at a time of requesting changes to an attendant of the gaming facility. The cashout button 25 is a button for inputting a command for paying as many coins as indicated by the total credit amount to a coin tray 18.

The 1-BET button 26 is a button for inputting a command for betting one coin among as many coins as indicated by the total credit amount to the game. The Max-BET button 27 is a button for inputting a command for betting maximum number (50, for example) of coins that can be bet per one game among as many coins as indicated by the total credit amount to the game.

The bill validator 22 validates whether a bill is the legitimate one or not and accepts a legitimate bill into the cabinet 11. The bill validator 22 reads a bar code attached ticket 39 to be described below. In the case where the bar code attached ticket 39 is read, the bill validator 22 outputs a reading signal regarding the contents that are read to the main CPU 41.

On the lower front surface of the main door 13, that is on the lower part of the control panel 20, there is provided a belly glass 34 on which characters of the slot machine 10 and the like are depicted.

On a front surface of the top box 12, an upper side image display panel 33 is provided. The upper side image display panel 33 has a liquid crystal panel, and on this liquid crystal panel, the effect image or the image for introducing the game content or explaining game rules, for example, will be displayed.

Also, on the top box 12, a speaker 29 for outputting sound is provided. On the lower side of the upper side image display panel 33, a ticket printer 35, a card reader 36, a data display 37, and a keypad 38 are provided. The ticket printer 35 prints a bar code which encodes data such as the total credit amount, the credit amount for jackpot, the date and time, the identification number of the slot machine 10, etc., on the ticket, and outputs it as the bar code attached ticket 39. In a case where the credit amount for jackpot becomes greater than or equal to a prescribed jackpot threshold ("500", for example), the slot machine 10 determines whether or not to pay as many coins as the credit amount for jackpot. In a case where it is determined that as many coins as the credit amount for jackpot are to be paid, the slot machine 10 stops symbols "JACKPOT7" in all of the display regions 28*a*1 to 28*e*5, and pays as many coins as the credit amount for jackpot. Note that the credit amount for jackpot is stored in the RAM 43.

The player can use the bar code attached ticket 39 to play the game on another slot machine or exchange the bar code attached ticket 39 with the bills or the like at the cashier or the like of the gaming facility.

The card reader 36 carries out reading of data from a smart card and writing of data into a smart card. The smart card is a card to be owned by the player, which stores data for identifying the player or data regarding log of games played by the player, for example.

The data display 37 comprises a fluorescent display or the like, and displays data read by the card reader 36, or data inputted by the player through the key pad 38, for example. The key pad 38 inputs data and commands regarding the ticket issuance or the like.

Figure 5:
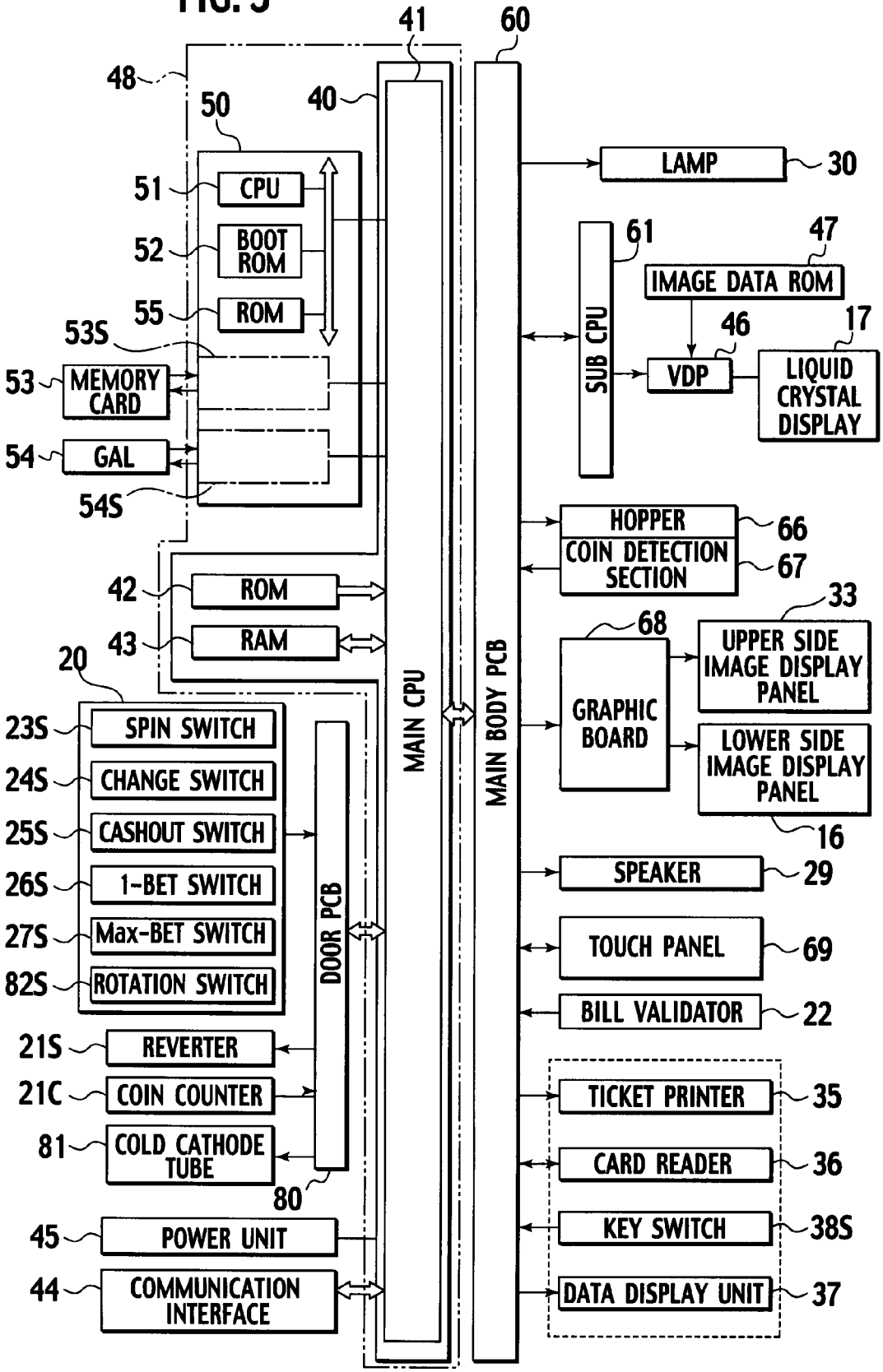
FIG. 5 is a block diagram showing a control circuit of the slot machine according to the first embodiment of the present invention.

FIG. 5 is a block diagram showing a control circuit of the slot machine 10 shown in FIG. 2. As shown in FIG. 5, the control circuit comprises the mother board 40, a main body PCB (Printed Circuit Board) 60, a sub CPU 61, the gaming board 50, a door PCB 80, and various types of switches and sensors. A controller 48 comprises the mother board 50 and the gaming board 50.

The gaming board 50 has the CPU (Central Processing Unit) 51, a ROM 55 and the boot ROM 52 which are mutually connected through an internal bus, the card slot 53S corresponding to the memory card 53, and the IC socket 54S corresponding to the GAL (Generic Array Logic) 54.

The memory card 53 stores a game program and a game system program. The game program includes a symbols to be stopped determination program. The symbols to be stopped determination program is a program for determining symbols (code numbers corresponding to symbols) to be stopped in the display regions 28*a*1 to 28*e*5. This symbols to be stopped determination program contains symbol weighing data respectively corresponding to plural types of payout rates (80%, 84%, 88%, for example). The symbol weighing data are data indicating the correspondence relationship between the code number of each symbol (see FIG. 4), and one or a plurality of random number values belonging to a prescribed numerical value range (0 to 255), for each of the display regions 28*a*1 to 28*e*5.

The payout rate is determined according to the payout rate setting data outputted from the GAL 54. The symbols to be stopped in the display regions 28*a*1 to 28*e*5 are determined according to the symbol weighing data corresponding to this payout rate.

Also, the card slot 53S is formed such that the memory card 53 can be inserted or extracted, and connected to the mother board 40 through the IDE bus. Consequently, by extracting the memory card 53 from the card slot 53S, writing the other game program and game system program into the memory card 53, and inserting that memory card 53 into the card slot 53S, it is possible to change a type and a content of the game to be played on the slot machine 10.

The game program includes a program related to the game progress. The game program also contains image data and sound data to be outputted during the game. In addition, the game program also contains image data and sound data as the notification data for notifying to the player that the holding game will be executed and that the pressing operation of the touch panel 69 is possible, in the case where the holding game is to be executed.

The GAL 54 has a plurality of input ports and output ports, and when data are inputted into the input ports, data corresponding to these data are outputted from the output ports. The data outputted from the output ports are the payout rate setting data mentioned above.

Also, the IC socket 54S is formed such that the GAL 54 can be attached or detached, and connected to the mother board 40 through the PCI bus. Consequently, by detaching the GAL 54 from the IC socket 54S, rewriting the program stored in the GAL 54, and attaching that GAL 54 to the IC socket 54S, it is possible to change the payout rate setting data to be outputted from the GAL 54.

The CPU 51, the ROM 55 and the boot ROM 52 that are mutually connected through the internal bus are connected to the mother board 40 through the PCI bus. The PCI bus carries out the signal transmission between the mother board 40 and the gaming board 50, as well as the power supply from the mother board 40 to the gaming board 50. The ROM 55 stores the country identification information and the authentication program. The boot ROM 52 stores the spare authentication program and a program (boot codes) for the CPU 51 to activate the spare authentication program.

The authentication program is a program (alteration checking program) for authenticating the game program and the game system program. Namely, the authentication program is a program for carrying out the checking and the verification of the fact that the game program and the game system program are not altered. The authentication program is described along a procedure for carrying the authentication of the game program and the game system program. The spare authentication program is a program for authenticating the above described authentication program. The spare authentication program is described along a procedure for carrying out the verification that the authentication program that is a target of the authentication processing is not altered, that is, the authentication of the authentication program.

The mother board 40 has the main CPU 41, the ROM (Read Only Memory) 42, the RAM (Random Access Memory) 43, and a communication interface 44.

The main CPU 41 outputs a scrolling command signal for scrolling symbols on the liquid crystal display 17 to the sub CPU 61 when a part of coins among as many coins as indicated by the total credit amount is bet and the spin button 23 is pressed, and after symbols are scrolled, the main CPU 41 determines symbols to be stopped in the display regions 28*a*1 to 28*e*5 and outputs a stopping command signal for stopping determined symbols in the display regions 28*a*1 to 28*e*5 to the sub CPU 61. The sub CPU 61 carries out various processings according to the signals given from the main CPU 41.

The main CPU 41 executes the holding game in a case where a prescribed condition to be described below is satisfied (see steps S15 to S16 of FIG. 8). The details of the holding game will be described below.

The ROM 42 stores programs such as BIOS (Basic Input/Output System) to be executed by the main CPU 41, as well as data to be used permanently. When the BIOS is executed by the main CPU 41, the processing for initializing each peripheral device is carried out and the processing for reading the game program and the game system program stored in the memory card 53 through the gaming board 50 is started. The ROM 42 stores a prize table shown in FIG. 6. The prize table indicates a correspondence relationship between a condition for paying coins and a number of coins to be paid in a case where this condition is satisfied. The condition for paying coins is indicated by symbols stopped in any of the display regions 28*a*1 to 28*e*5, that is the stopped symbols, and a number of these stopped symbols. The main CPU 41 determines whether or not to pay coins and a number of coins to be paid according to symbols stopped in the display regions 28*a*1 to 28*e*5 and this prize table in the base game. According to this prize table, the number of coins to be paid becomes 2*BET number in a case where ten or more symbols "PLUM" are stopped in the display regions 28, for example. Here, the BET number is a number of coins bet at the slot machine 10.

The RAM 43 stores data and programs to be used when the main CPU 41 carries out the processing. Also, the RAM 43 has a region for storing the number n of times for which the holding game has been executed, a region for storing a number m of symbols to be stopped, a region for storing the credit amount for jackpot, and a region for storing the total credit amount. The number n of times for which the holding game has been executed and the number m of symbols to be stopped are parameters related to the holding game, which will be described in detail below.

The communication interface 44 carries out communications with the host computer or the like that is provided inside the gaming facility through a communication channel.

Also, to the Mother board 40, a main body PCB (Printed Circuit Board) 60 and a door PCB 80 to be described below are connected through the respective USB (Universal Serial Bus). In addition, a power source unit 45 is connected to the mother board 40. When the power is supplied from the power source unit 45 to the mother board 40, the main CPU 41 of the mother board 40 is activated, and the power is supplied to the gaming board 50 through the PCI bus and the CPU 51 is activated.

To the main body PCB 60 and the door PCB 80, devices for generating input signals to be inputted into the main CPU 41 and devices whose operations are to be controlled by control signals outputted from the main CPU 41 are connected. The main CPU 41 executes the game program and the game system program stored in the RAM 43 according to the input signals inputted into the main CPU 41. Then, the main CPU 41 carries out the calculation processing according to these programs and stores the result into the RAM 43, and the processing for transmitting control signals to each device as the control processing with respect to each device.

To the main body PCB 60, a lamp 30, a sub CPU 61, a hopper 66, a coin detection unit 67, a graphic board 68, a speaker 29, a touch panel 69, a bill validator 22, a ticket printer 35, a card reader 36, a key switch 38S, and a data display 37 are connected. The lamp 30 is controlled to be turned on or off by the main CPU 41.

The sub CPU 61 is for scrolling and stopping symbols in the display regions 28*a*1 to 28*e*5 that are set in the liquid crystal display 17, and is connected to a VDP (Video Display Processor) 46.

The VDP 46 reads out the image data of symbols stored in the image data ROM 47, generates the scrolling images to be displayed at the liquid crystal display 17, and outputs the scrolling images to the liquid crystal display 17.

The hopper 66 is provided inside the cabinet 11, and pays the prescribed number of coins according to the control signal outputted from the main CPU 41, from a coin payout opening 19 to a coin tray 18. The coin detection unit 67 is provided inside the coin payout opening 19, and outputs an input signal with respect to the main CPU 41 when it is detected that the prescribed number of coins are paid from the coin payout opening 19.

The graphic board 68 controls the image display on the upper side image display panel 33 and the lower side image display panel 16 according to the control signal outputted from the main CPU 41. On the credit amount display unit 31 of the lower side image display panel 16, the total credit amount stored in the RAM 43 is displayed. Also, on the payout amount display unit 32 on the lower side image display panel 16, the number of coins to be paid is displayed. Also, the graphic board 68 has a VDP for generating image data according to the control signal outputted from the main CPU 41 and a video RAM for temporarily storing the image data generated by the VDP.

The bill validator 22 reads an image of the bill and accepts the legitimate bill into the cabinet 11. The bill validator 22 outputs an input signal with respect to the main CPU 41 according to the amount of that bill when the legitimate bill is accepted. The main CPU 41 adds the credit amount according to the amount of the bill notified by that input signal to the total credit amount.

The ticket printer 35 prints the bar code which encodes data such as the total credit amount stored in the RAM 43, the date and time, the identification number of the slot machine 10, and the credit amount for jackpot, etc., on the ticket, according to the control signal outputted from the main CPU 41, and outputs it as the bar code attached ticket 39.

The card reader 36 reads data from the smart card and transmits it to the main CPU 41, or writes data into the smart card according to the control signal outputted from the main CPU 41. The key switch 38S is provided on the key pad 38, and outputs an input signal to the main CPU 41 when the key pad 38 is operated by the player.

The data display 37 displays the data read by the card reader 36 or the data inputted by the player through the key pad 38, according to the control signal outputted from the main CPU 41.

To the door PCB 80, the control panel 20, a reverter 21S, a coin counter 21C and a cold cathode tube 81 are connected. On the control panel 20, a spin switch 23S corresponding to the spin button 23, a change switch 24S corresponding to the change button 24, a cashout switch 25S corresponding to the cashout button 25, a 1-BET switch 26S corresponding to the 1-BET button 26, and a Max-BET switch 27S corresponding to the Max-BET button 27 are provided. Each one of the switches 23S to 27S outputs an input signal to the main CPU 41 when the corresponding one of the buttons 23 to 27 is operated by the player.

The coin counter 21C is provided inside the coin slot 21, and validates whether coins entered at the coin slot 21 are legitimate ones or not. Those coins that are not the legitimate ones will be ejected from the coin payout opening 19. Also, the coin counter 21C outputs an input signal to the main CPU 41 when the legitimate coins are detected.

The reverter 21S is operated according to a control signal outputted from the main CPU 41, to distribute the coins recognized as the legitimate coins by the coin counter 21C to the cash box (not shown) provided inside the slot machine 10 or the hopper 66. Namely, when the hopper 66 is filled with coins, the legitimate coins are distributed to the cash box by the reverter 21S. On the other hand, when the hopper 66 is not filled with coins, the legitimate coins are distributed to the hopper 66.

The cold cathode tube 81 functions as the background light provided on the back side of the lower side image display panel 16 and the upper side image display panel 33, and it is turned on according to a control signal outputted from the main CPU 41.

Next, the specific processing to be carried out at the slot machine 10 will be described. The slot machine 10 carries out a main processing shown in FIG. 7. Namely, at the step S100, the slot machine 10 carries out the authentication processing described above. After that, the main CPU 41 carries out a slot game execution processing shown in FIG. 8 repeatedly.

Figure 8:
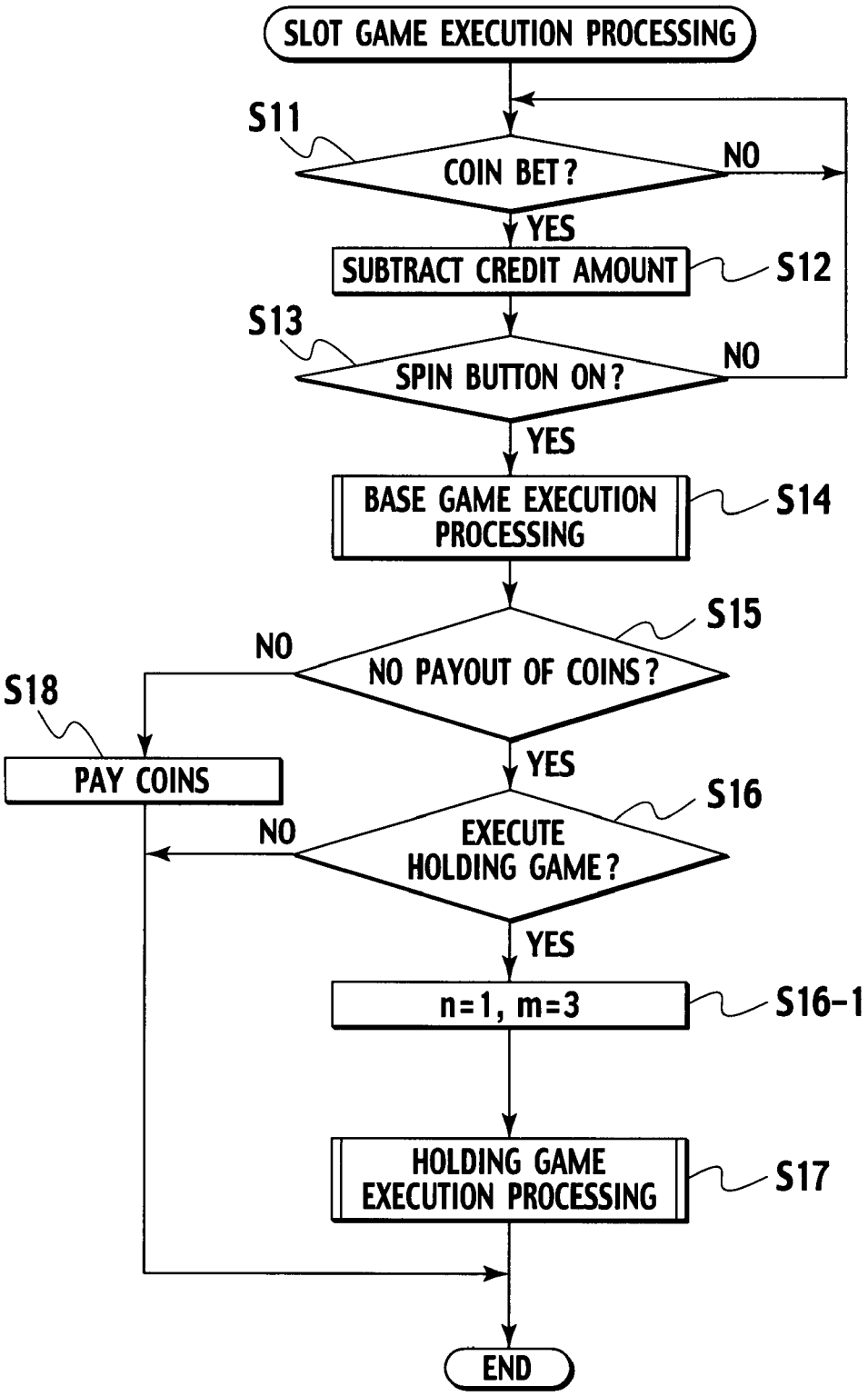
FIG. 8 is a flow chart showing a procedure of a slot game execution processing to be executed by the slot machine according to the first embodiment of the present invention.

FIG. 8 is a flow chart showing a procedure of the slot game execution processing. At the step S11, the main CPU 41 judges whether the coin BET has been made or not. In this processing, the main CPU 41 judges whether the input signal outputted from the 1-BET switch 26S when the 1-BET button 26 is pressed or the input signal outputted from the Max-BET switch 27S when the Max-BET button 27 is pressed has been received or not. When it is judged that the coin BET has not been made, the main CPU 41 returns to the step S11, whereas when it is judged that the coin BET has been made, the main CPU 41 proceeds to the step S12. Note that, when the reading signal is given from the bill validator 22, the main CPU 41 sets the total credit amount and the credit amount for jackpot according to that reading signal. In addition, when the input signal is given from the coin counter 21C, the main CPU 41 sets the total credit amount according to that input signal. In addition, when the input signal is given from the bill validator 22, the main CPU 41 sets the total credit amount according to that input signal.

At the step S12, the main CPU 41 carries out the processing for subtracting the total credit amount stored in the RAM 43 according to the number of coins to be bet, and proceeds to the step S13. Note that when the number of coins to be bet is greater than the total credit amount stored in the RAM 43 or when the number of coins to be bet exceeds the upper limit value (50 in this embodiment) that can be bet per one game, the CPU 41 returns the processing to the step S11, without carrying out the processing for subtracting the total credit amount stored in the RAM 43.

At the step S13, the main CPU 41 judges whether the spin button 23 is turned ON or not. In this processing, the main CPU 41 judges whether the input signal outputted from the spin switch 23S is received or not.

When it is judged that the spin button 23 is not turned ON, the main CPU 41 returns the processing to the step S11, whereas when it is judged that the spin button 23 is turned ON, the main CPU 41 proceeds to the step S14. Note that in the case where a command indicating the finishing of the game is inputted without turning the spin button 23 ON (as the command indicating the finishing of the game, there can be the case where the cashout button 25 is pressed or the case where the issuance of the bar code attached ticket 39 is requested, for example), the main CPU 41 cancels the subtraction result at the step S12.

In this embodiment, the main CPU 41 carries out the processing for subtracting the total credit amount (step S12) after the coin BET is made (step S11) and before making the judgment as to whether the spin button 23 is turned ON or not (step S13). However, the present invention is not limited to this exemplary case. For example, it is also possible for the main CPU 41 to make the judgment as to whether the spin button 23 is turned ON or not (step S13) after the coin BET is made (step S11), and carry out the processing for subtracting the total credit amount (step S12) when it is judged that the spin button 23 is turned ON (step S13 YES).

Figure 9:
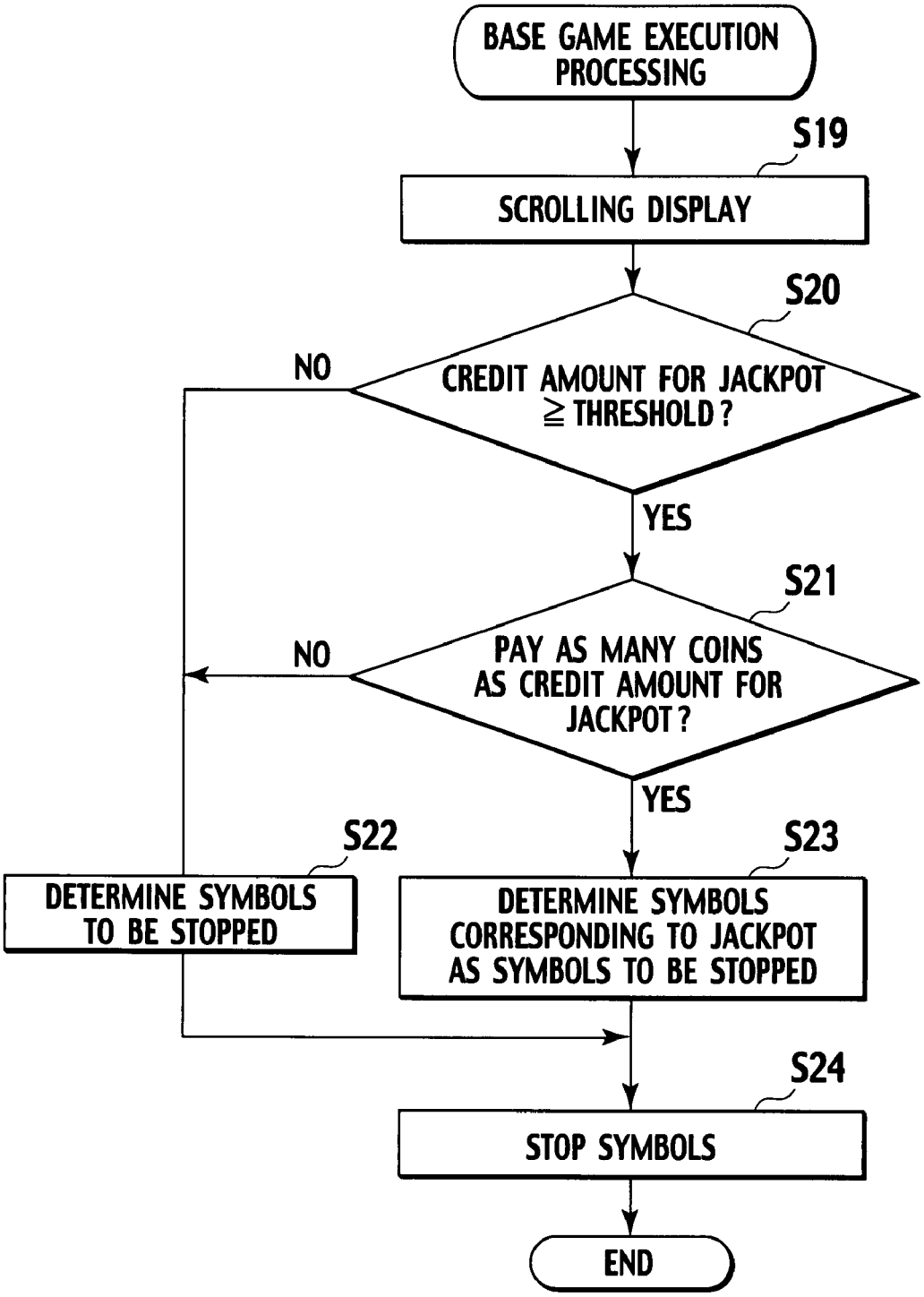
FIG. 9 is a flow chart showing a procedure of a base game execution processing to be executed by the slot machine according to the first embodiment of the present invention.

At the step S14, the main CPU 41 carries out a base game execution processing shown in FIG. 9. In outline, the main CPU 41 scrolls symbols in the display regions 28*a*1 to 28*e*5 and automatically stops symbols in the display regions 28*a*1 to 28*e*5.

Figures 6, 7:
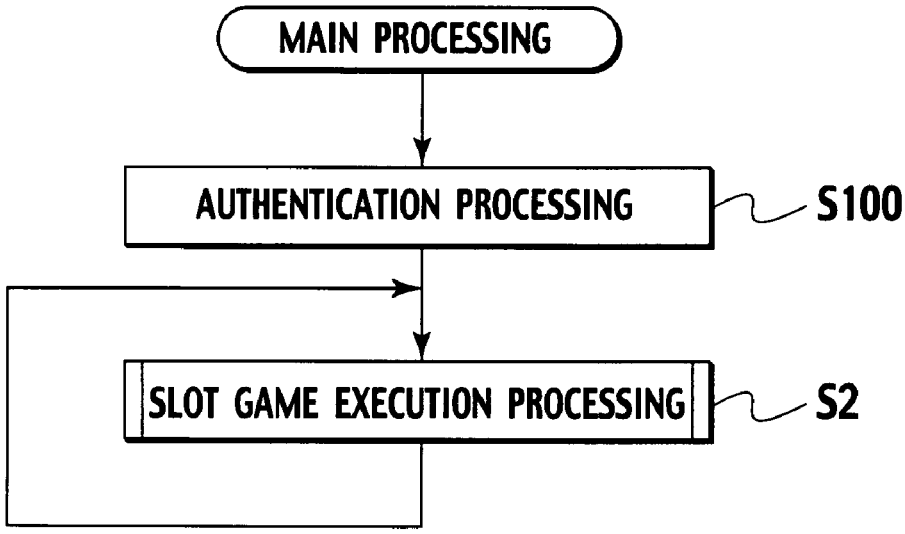
FIG. 6 is a diagram showing a prize table to be referred in the slot machine according to the first embodiment of the present invention.
FIG. 7 is a flow chart showing a procedure of a main processing to be executed by the slot machine according to the first embodiment of the present invention.

At the step S15, the main CPU 41 determines whether or not to make a payout of coins according to symbols stopped by the base game and the prize table shown in FIG. 6. More specifically, it is determined that a payout of coins is to be made in a case where symbols "JACKPOT7" are stopped in all of the display regions 28*a*1 to 28*e*5. On the other hand, in a case where a symbol other than "JACKPOT7" is stopped in any of the display regions 28*a*1 to 28*e*5, the main CPU 41 judges conditions indicated by the prize table, and determines that a payout of coins is to be made when any of the conditions indicated by the prize table is satisfied, or determines that a payout of coins is not to be made when none of the conditions indicated by the prize table is satisfied. In the case where it is determined that a payout of coins is to be made, the main CPU 41 proceeds to the step S18, and in the case where it is determined that a payout of coins is not to be made, the main CPU 41 proceeds to the step S16.

At the step S16, the main CPU 41 determines whether or not to execute the holding game. More specifically, the main CPU 41 generates one random number within a range of 0 to 65535, and judges whether a condition that the generated random number is contained in a prescribed holding game execution possible range (1000 to 3000, for example) is satisfied or not, and in the case where this condition is satisfied, the main CPU 41 determines to execute the holding game, whereas in the case where this condition is not satisfied, the main CPU 41 determines not to execute the holding game. In the case where it is determined to execute the holding game, the main CPU 41 proceeds to the step S16-1, and in the case where it is determined not to execute the holding game, the slot game execution processing is terminated.

At the step S16-1, the main CPU 41 sets the number n of times for which the holding game has been executed to "1", and sets the number m of symbols to be stopped to "3".

Figure 10:
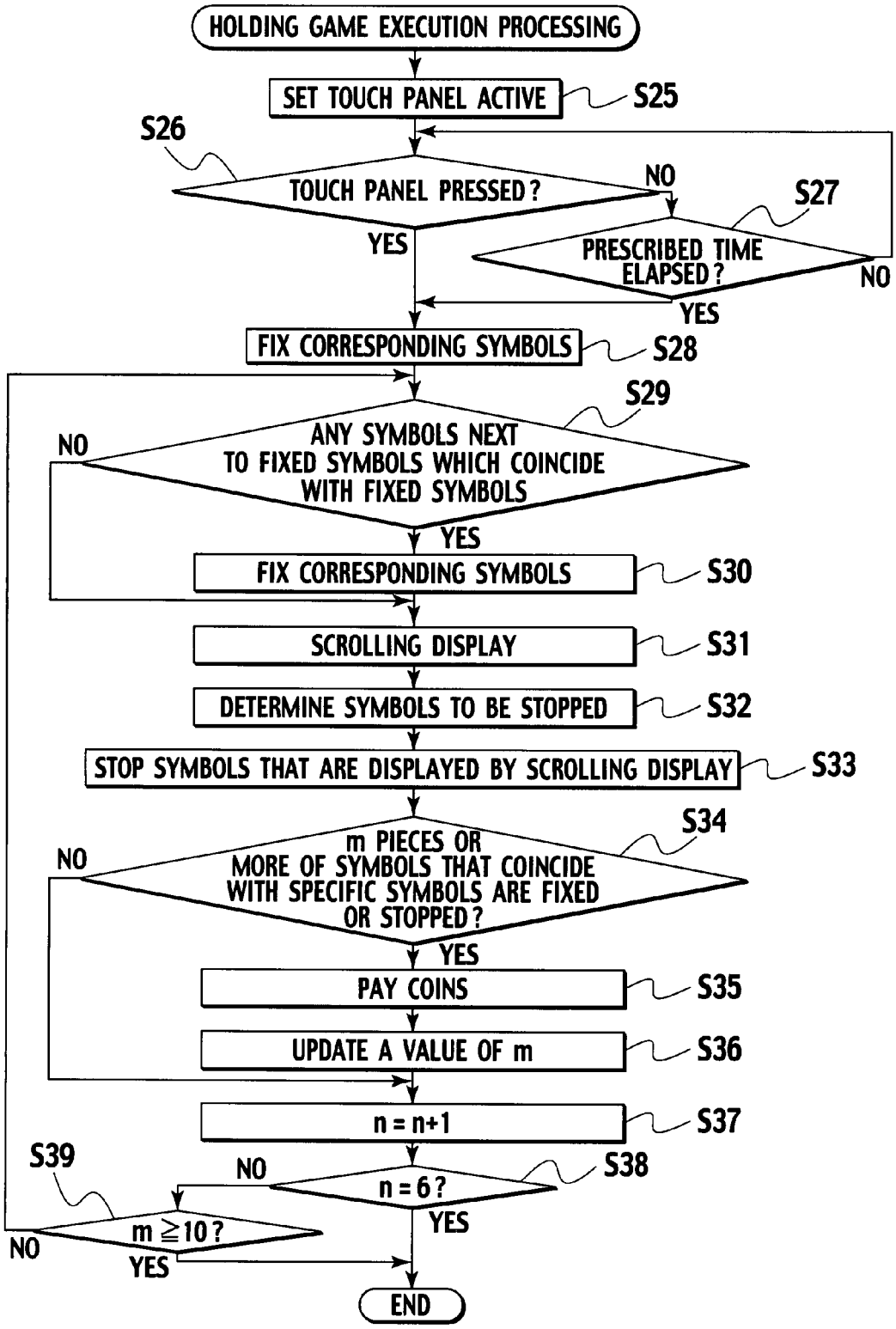
FIG. 10 is a flow chart showing a procedure of a holding game execution processing to be executed by the slot machine according to the first embodiment of the present invention.

At the step S17, the main CPU 41 carries out the holding game execution processing shown in FIG. 10. In outline, the main CPU 41 executes the holding game for a plurality of times by carrying out a processing for setting the touch panel 69 active and a processing for fixing symbols selected by the pressing operation of the touch panel 69. After that, the main CPU 41 terminates the slot game execution processing.

At the step S18, the main CPU 41 increases the total credit amount as much as the credit amount for jackpot in the case where symbols "JACKPOT7" are stopped in all of the display regions 28*a*1 to 28*e*5. On the other hand, in the case where a symbol other than "JACKPOT7" is stopped in any of the display regions 28*a*1 to 28*e*5, the main CPU 41 determines a number of coins to be paid according to symbols stopped by the base game and the prize table shown in FIG. 6, deposits a part of coins among the determined number of coins to be paid for jackpot, and pays the rest of coins. More specifically, the main CPU 41 increases the credit amount for jackpot by "3", and increases the total credit amount by a value obtained by subtracting "3" from the determined number of coins to be paid. For example, when eight symbols "APPLE" are stopped by the base game and the BET number is "5" as shown in FIG. 12, the main CPU 41 increases the credit amount for jackpot by "3", and increases the total credit amount by "12". After that, the main CPU 41 terminates the slot game execution processing.

FIG. 9 is a flow chart showing a procedure of the base game execution processing. At the step S19, the main CPU 41 starts the base game. More specifically, the main CPU 41 outputs a scrolling command signal for scrolling symbols on the liquid crystal display 17 to the sub CPU 61. The sub CPU 61 controls the VDP 46 according to the scrolling command signal. Under the control of the sub CPU 61, the VDP 46 reads out the image data of symbols stored in the image data ROM 47, and scrolls symbols in the display regions 28*a*1 to 28*e*5 of the liquid crystal display 17. In this way, the base game is started, and this state is shown in FIG. 11.

At the step S20, the main CPU 41 judges whether or not a condition that the credit amount for jackpot is greater than or equal to a prescribed jackpot threshold is satisfied, and proceeds to the step S21 in the case where this condition is satisfied, or proceeds to the step S22 in the case where this condition is not satisfied.

At the step S21, the main CPU 41 judges whether or not to make a payout of as many coins as the credit amount for jackpot. More specifically, the main CPU 41 generates one random number in a range of 0 to 65535, and judges whether or not a condition that the generated random number is contained within a prescribed jackpot realization range (a range of 150 to 151, for example) is satisfied. As a result, the main CPU 41 judges that a payout of as many coins as the credit amount for jackpot is to be made in the case where this condition is satisfied, or judges that a payout of as many coins as the credit amount for jackpot is not to be made in the case where this condition is not satisfied. The main CPU 41 proceeds to the step S23 in the case where it is judged that a payout of as many coins as the credit amount for jackpot is to be made, or to the step S22 in the case where it is judged that a payout of as many coins as the credit amount for jackpot is not to be made.

At the step S22, the main CPU 41 generates one random number in a range of 0 to 255 in each one of the display regions 28*a*1 to 28*e*5. The main CPU 41 refers to the symbol weighing data according to the payout rate setting data outputted from the GAL 54 and stored in the RAM 43, and determines the code numbers (see FIG. 3) of symbols to be stopped in the display regions 28*a*1 to 28*e*5 according to the generated 25 random numbers. In this way, the main CPU 41 determines symbols to be stopped in the display regions 28*a*1 to 28*e*5. Note that, at the step S22, symbols to be stopped in the display regions 28*a*1 to 28*e*5 will not be determined as all symbols "JACKPOT7". Namely, the main CPU 41 sets the code number other than the code number of "JACKPOT7" for any one display region, in the case where the code numbers corresponding to "JACKPOT7" are determined for all of the display regions 28*a*1 to 28*e*5. The main CPU 41 outputs the stopping command signal for stopping the determined symbols in the display regions 28*a*1 to 28*e*5 to the sub CPU 61.

At the step S23, the main CPU 41 determines symbols to be stopped in the display regions 28*a*1 to 28*e*5 as all symbols "JACKPOT7". The main CPU 41 outputs the stopping command signal for stopping the determined symbols in the display regions 28*a*1 to 28*e*5 to the sub CPU 61.

At the step S24, the main CPU 41 terminates the base game by controlling the sub CPU 61. More specifically, the sub CPU 61 controls the VDP 46 according to the stopping command signal transmitted from the main CPU 41 (that is, under the control of the main CPU 41). The VDP 46 reads out the image data of symbols stored in the image data ROM 47 and stops symbols in the display regions 28*a*1 to 28*e*5 of the liquid crystal display 17 under the control of the sub CPU 61. Here, symbols stopped in the display regions 28*a*1 to 28*e*5 coincide with symbols determined by the main CPU 41.

Figure 13:
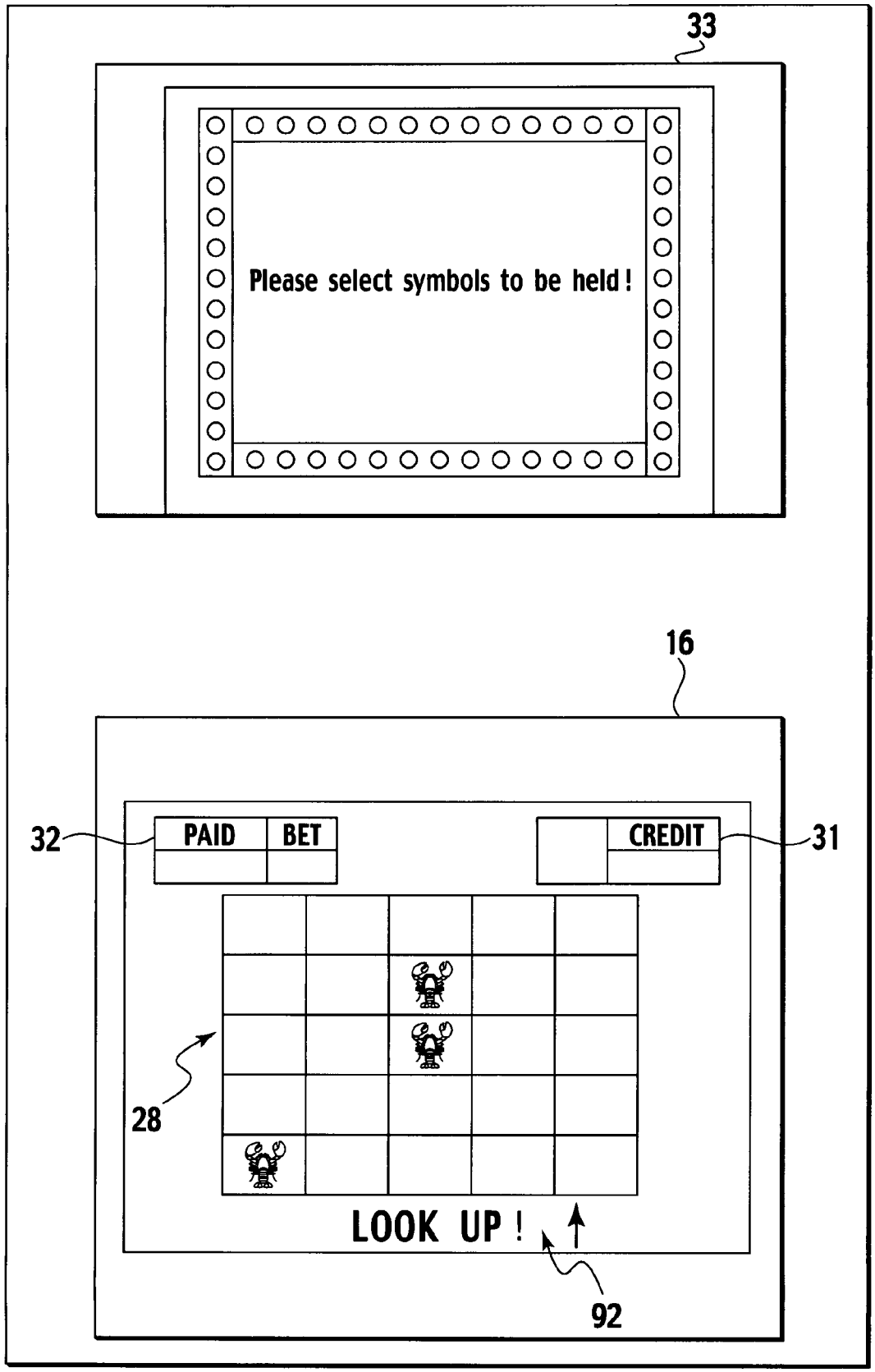
FIG. 13 is a diagram showing an exemplary display for notifying that it is possible to operate a touch panel by pressing it in the slot machine according to the first embodiment of the present invention.
Figure 14:
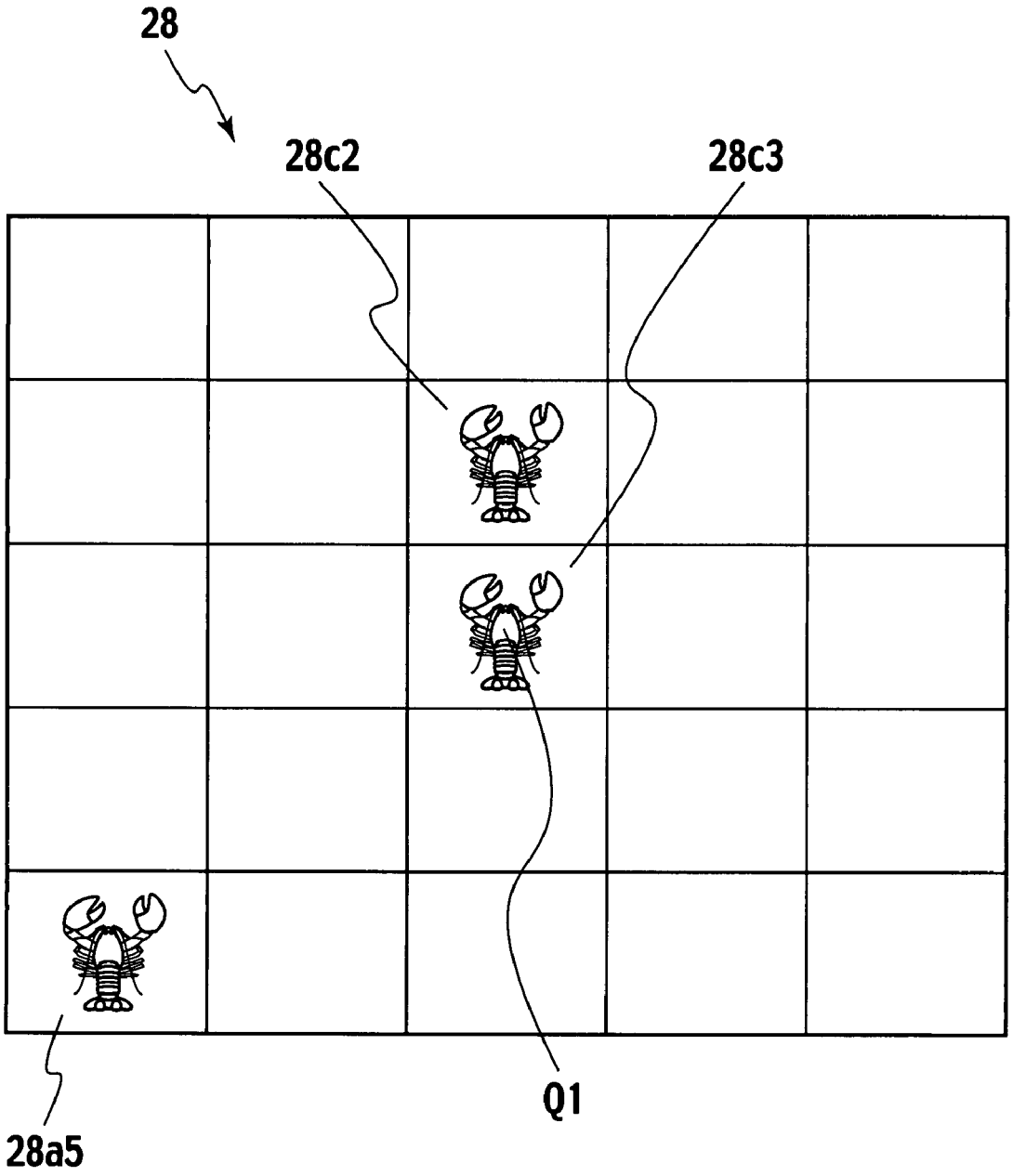
FIG. 14 is a diagram showing one example of symbols to be rearranged in the slot machine according to the first embodiment of the present invention.

FIG. 10 is a flow chart showing a procedure of the holding game execution processing. At the step S25, the main CPU 41 starts the n-th holding game. Here, n=1 at this point, so that the main CPU 41 starts the first holding game. More specifically, the main CPU 41 activates the touch panel 69. Namely, the main CPU 41 becomes possible to accept (that is, possible to receive) the control input signal from the touch panel 69. Here, the base game is already finished at this point, so that symbols determined by the main CPU 41 in the base game are stopping in the display regions 28*a*1 to 28*e*5. In addition, the main CPU 41 displays letters "Please select symbols to be held!" on the upper side image display panel 33 of the slot machine 10 as shown in FIG. 13. In addition, the main CPU 41 displays an image 92 showing an arrow pointing upwards and letters "LOOK UP!" on a lower portion of the lower side image display panel 16. In this way, it is possible to notify to the player that it is executing the first holding game. It may also be made to notify this at the same time by the sound or the electric decoration. Note that, in an example shown in FIG. 13, symbols "LOBSTER" are stopping in the display regions 28*a*5, 28*c*2 and 28*c*3 as a result of the base game, as shown in detail in FIG. 14. Note also that, in examples shown in FIG. 13 to FIG. 21 symbols other than "LOBSTER" are omitted.

At the step S26, the main CPU 41 judges whether a condition that the pressing operation on the touch panel 69 is made, or more specifically, a condition that the control input signal from the touch panel 69 is given is satisfied or not, and proceeds to the step S28 in the case where this condition is satisfied, or proceeds to the step S27 in the case where this condition is not satisfied.

At the step S27, the main CPU 41 judges whether a condition that a prescribed time (10 seconds, for example) has elapsed since the processing of the step S25 is finished is satisfied or not, and proceeds to the step S28 in the case where this condition is satisfied by regarding that the arbitrary control input signal from the touch panel 69 is given, or proceeds to the step S26 in the case where this condition is not satisfied.

Figure 15:
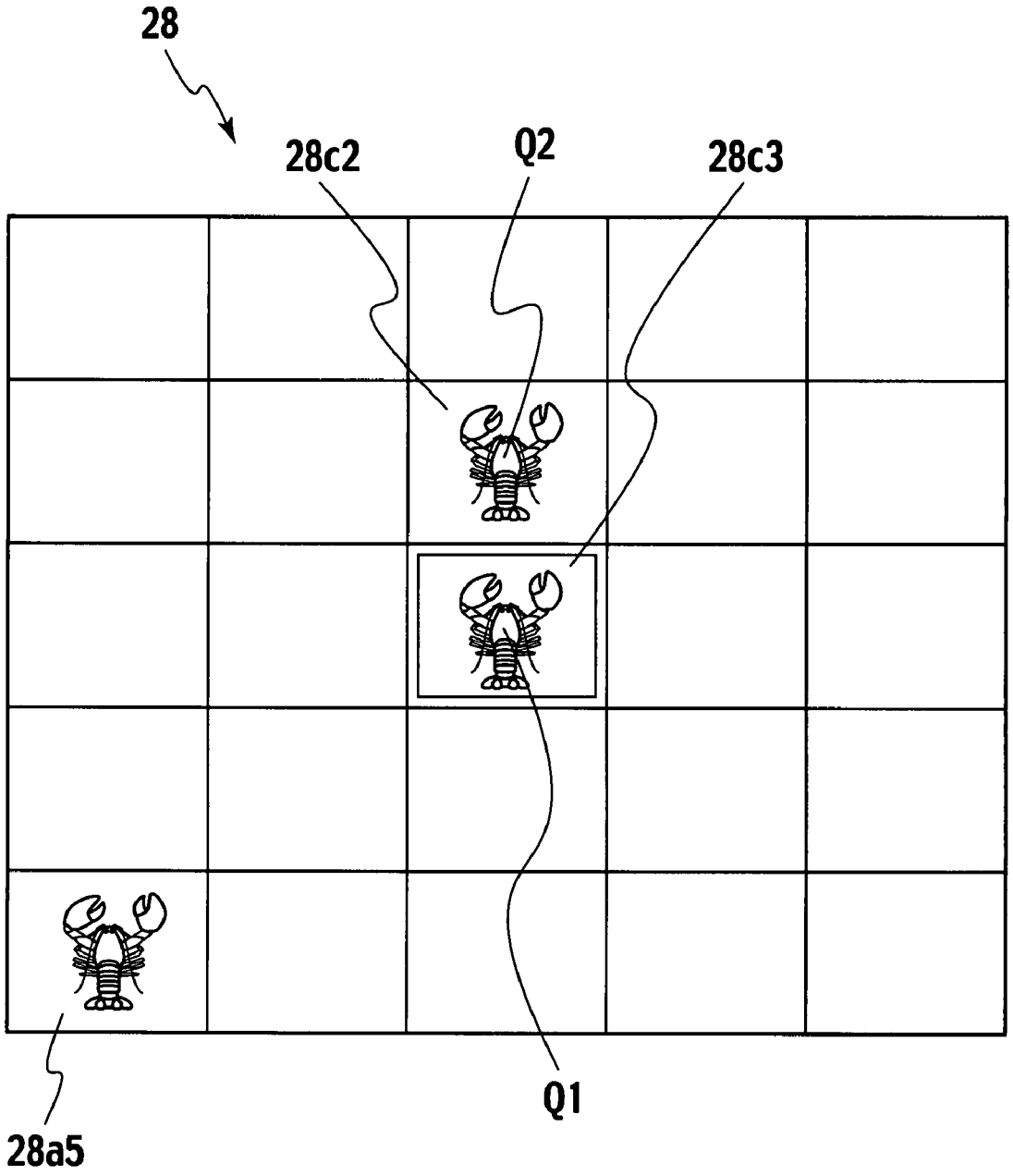
FIG. 15 is a diagram showing one example of symbols to be fixed or rearranged in the slot machine according to the first embodiment of the present invention.

At the step S28, the main CPU 41 specifies the display region corresponding to the control input signal given from the touch panel 69 as a specific display region, and recognizes that a symbol stopped in that specific display region is selected by the player. In this way, the player can select a symbol by making the pressing operation on the touch panel 69. In the following, a symbol selected by the player will be referred to as "specific symbol". The main CPU 41 fixes the specific symbol and displays the fixed specific symbol with emphasis. For example, in the case where the player selected a symbol Q1 (that is, a symbol "LOBSTER") stopped in the display region 28*c*3 in an example shown in FIG. 14, the main CPU 41 fixes the symbol Q1 as shown in FIG. 15. In addition, the main CPU 41 displays the symbol Q1 with emphasis by enclosing the symbol Q1 with double frame lines. In this way, the player can easily comprehend which symbol is being fixed.

At the step S29, the main CPU 41 judges whether a condition that there is a symbol which is next to the fixed symbol from any of up, down, left and right directions and which coincides with the fixed symbol is satisfied or not, and proceeds to the step S30 in the case where this condition is satisfied, or proceeds to the step S31 in the case where this condition is not satisfied.

Figure 16:
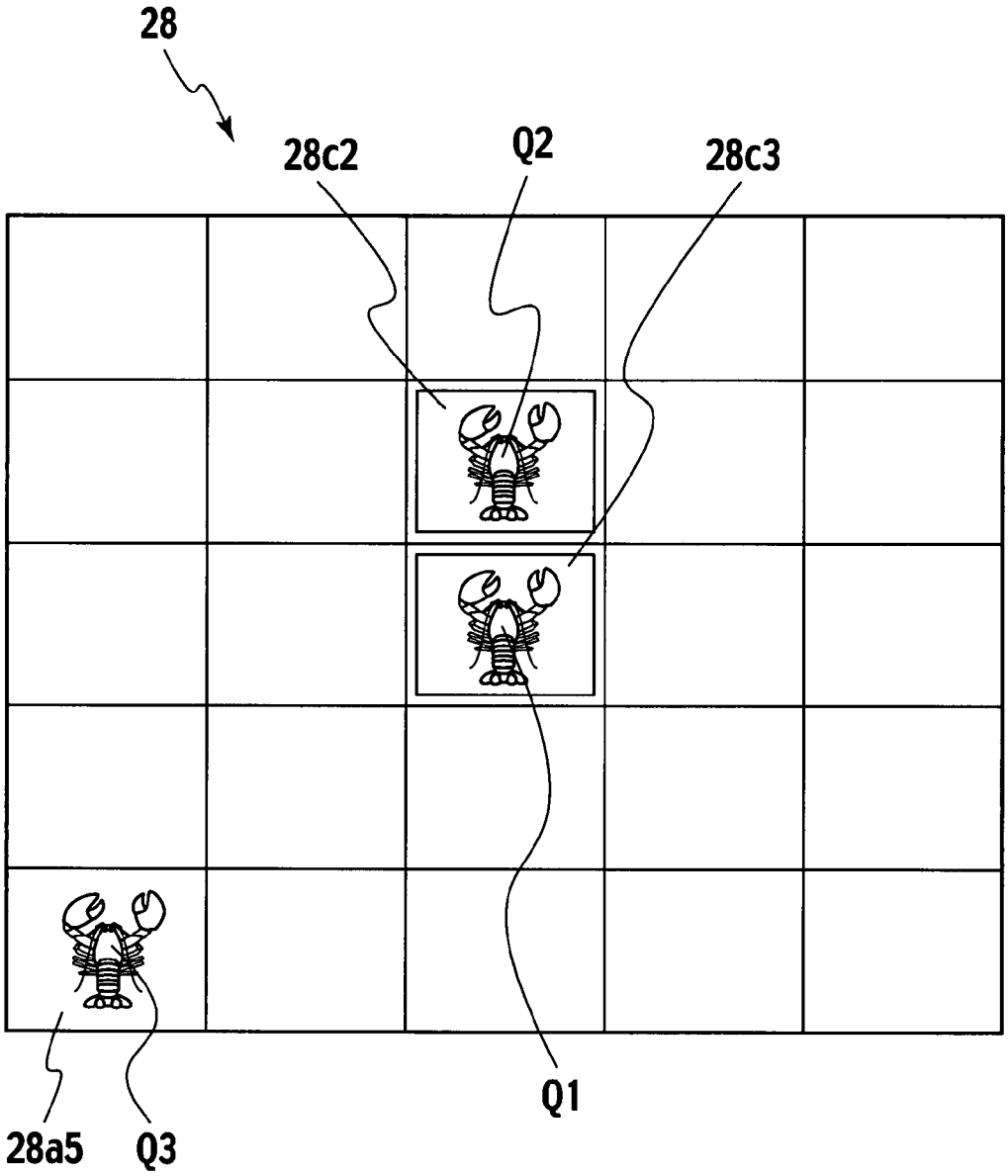
FIG. 16 is a diagram showing one example of symbols to be fixed or rearranged in the slot machine according to the first embodiment of the present invention.

At the step S30, the main CPU 41 fixes a symbol that satisfies the condition of the step S29 (that is, a symbol which is next to the fixed symbol from any of up, down, left and right directions and which coincides with the fixed symbol), and displays the fixed symbol with emphasis. In an example shown in FIG. 15, a symbol Q2 is a symbol which is next to the fixed symbol Q1 from the up direction and which coincides with the fixed symbol Q1, so that the main CPU 41 fixes the symbol Q2 and displays the symbol Q2 with emphasis as shown in FIG. 16. Note that a symbol Q3 coincides with the symbol Q1 but it is not next to the symbol Q1 from any of up, down, left and right directions. Consequently, the main CPU 41 does not fix the symbol Q3.

Figure 17:
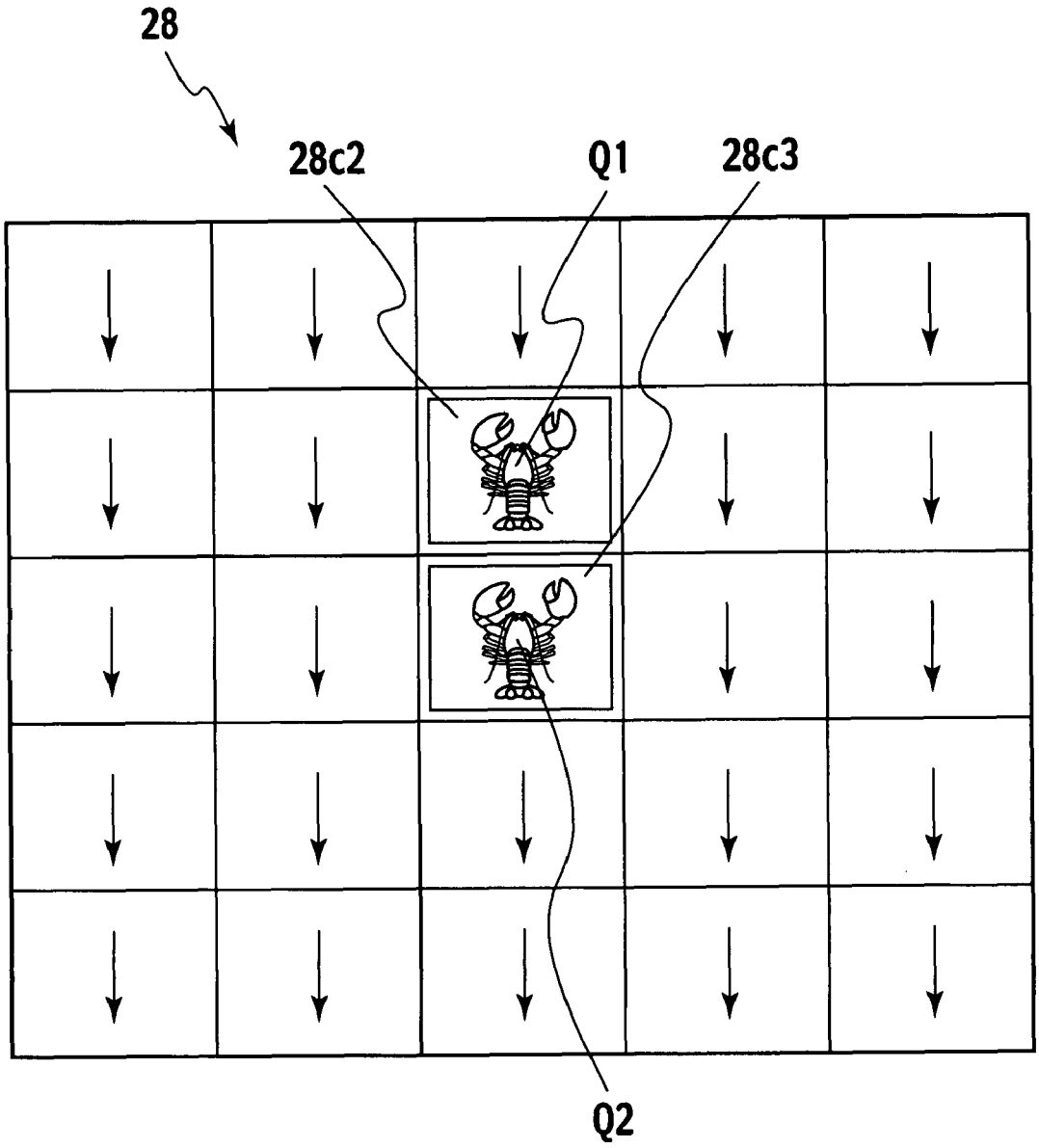
FIG. 17 is a diagram showing one example of symbols to be fixed or scrolled in the slot machine according to the first embodiment of the present invention.
Figure 18:
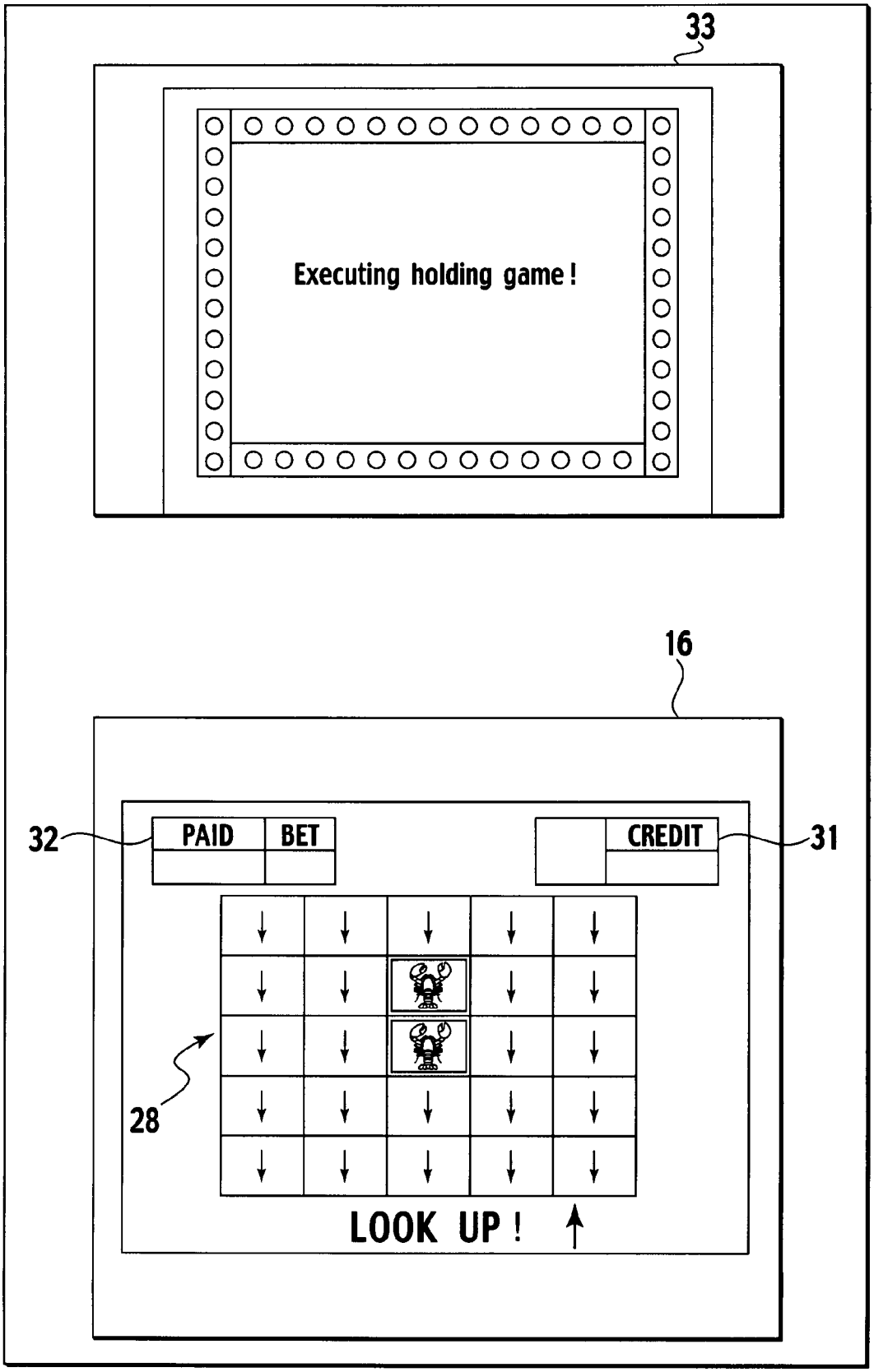
FIG. 18 is a diagram showing an exemplary display for notifying that it is executing the holding game in the slot machine according to the first embodiment of the present invention.

At the step S31, the main CPU 41 outputs the scrolling command signal for scrolling symbols other than the fixed symbols, and the sub CPU 61 controls the VDP 46 according to the scrolling command signal transmitted from the main CPU 41 such that the VDP 46 scrolls symbols under the control of the sub CPU 61. In an example shown in FIG. 16, the symbols Q1 and Q2 are fixed, so that symbols other than the symbols Q1 and Q2 are scrolled as shown in FIG. 17. In addition, the main CPU 41 displays letters "Executing holding game!" on the upper side image display panel 33 of the slot machine 10 as shown in FIG. 18.

At the step S32, the main CPU 41 determines symbols to be stopped in the display regions in which symbols are scrolled, by the processing similar to the processing of the step S22. The main CPU 41 generates the stopping command signal for stopping the determined symbols, and outputs it to the sub CPU 61.

Figure 19:
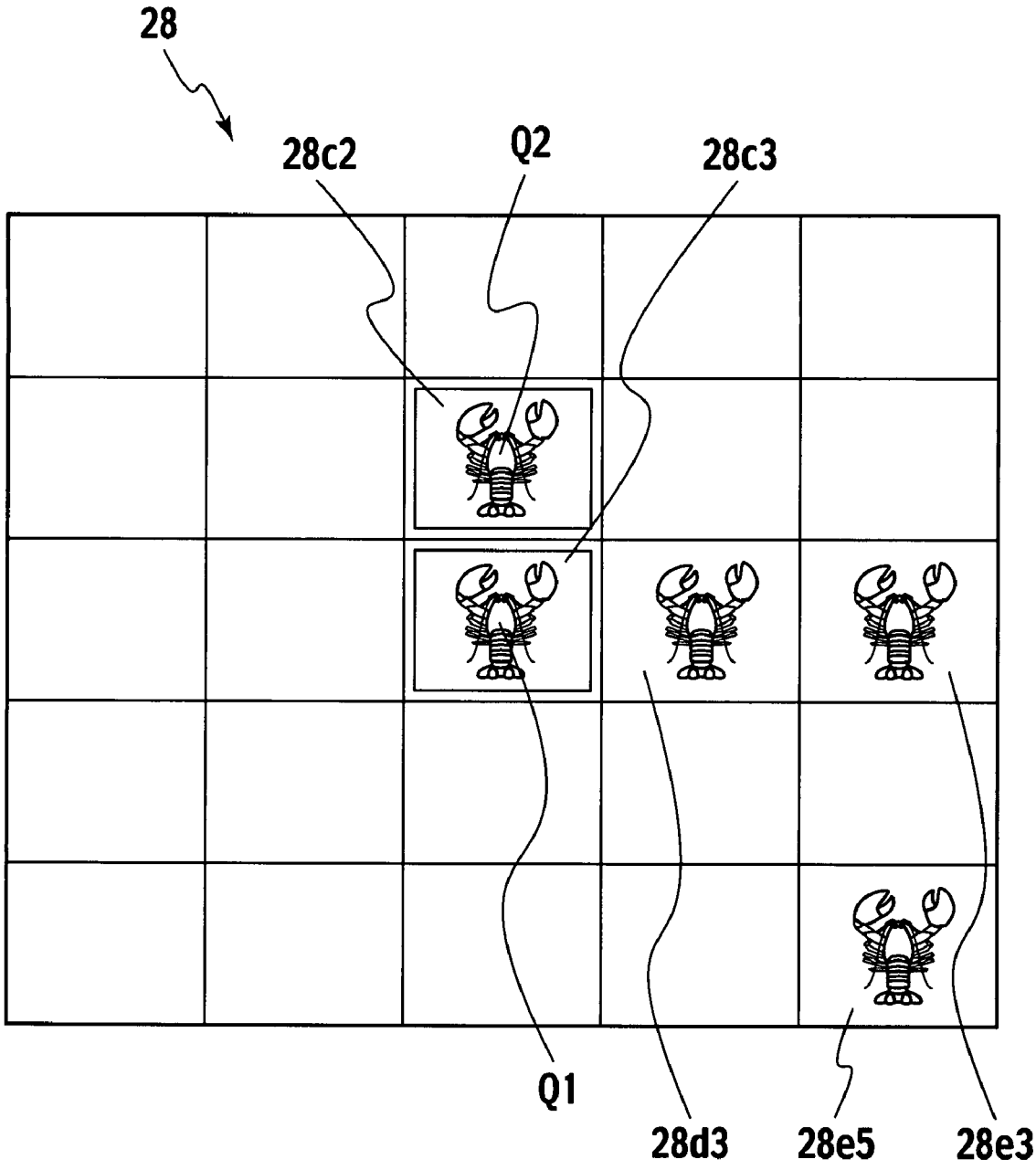
FIG. 19 is a diagram showing one example of symbols to be fixed or rearranged in the slot machine according to the first embodiment of the present invention.

At the step S33, the main CPU 41 finishes the n-th holding game by controlling the sub CPU 61. More specifically, the sub CPU 61 controls the VDP 46 according to the stopping command signal transmitted from the main CPU 41 (that is, under the control of the main CPU 41) such that the VDP 46 stops symbols under the control of the sub CPU 61. As a result, symbols are stopped in the display regions other than the display regions 28*c*2 and 28*c*3 as shown in FIG. 19, for example. In an example shown in FIG. 19, symbols "LOBSTER" are stopped in the display regions 28*d*3, 28*e*3 and 28*e*5.

At the step S34, the main CPU 41 judges whether a condition that m pieces or more of symbols that coincide with the specific symbol (which will be referred to as "coinciding symbols" in the following, and the coinciding symbols include the specific symbol) are fixed or stopped is satisfied or not, and proceeds to the step S35 in the case where this condition is satisfied, or proceeds to the step S37 in the case where this condition is not satisfied. In an example shown in FIG. 19, two symbols "LOBSTER" that are the coinciding symbols are fixed, and three symbols "LOBSTER" are stopped. Consequently, if a value of m is 5 or less, the condition of the step S34 will be satisfied.

At the step S35, the main CPU 41 increases the credit amount for jackpot by "3", and increases the total credit amount by (5*r−3). Here, r indicates a total number of the coinciding symbols at a current timing, and r=5 in an example shown in FIG. 19.

At the step S36, the main CPU 41 updates a value of m to a total number of the coinciding symbols at a current timing. In an example shown in FIG. 19, when the processing of the step S36 is carried out, a value of m is updated to "5".

At the step S37, the main CPU 41 increases a value of n by "1".

At the step S38, the main CPU 41 judges whether a condition that a value of n is "6" is satisfied or not, and terminates the holding game execution processing in the case where this condition is satisfied, or proceeds to the step S39 in the case where this condition is not satisfied.

Figure 20:
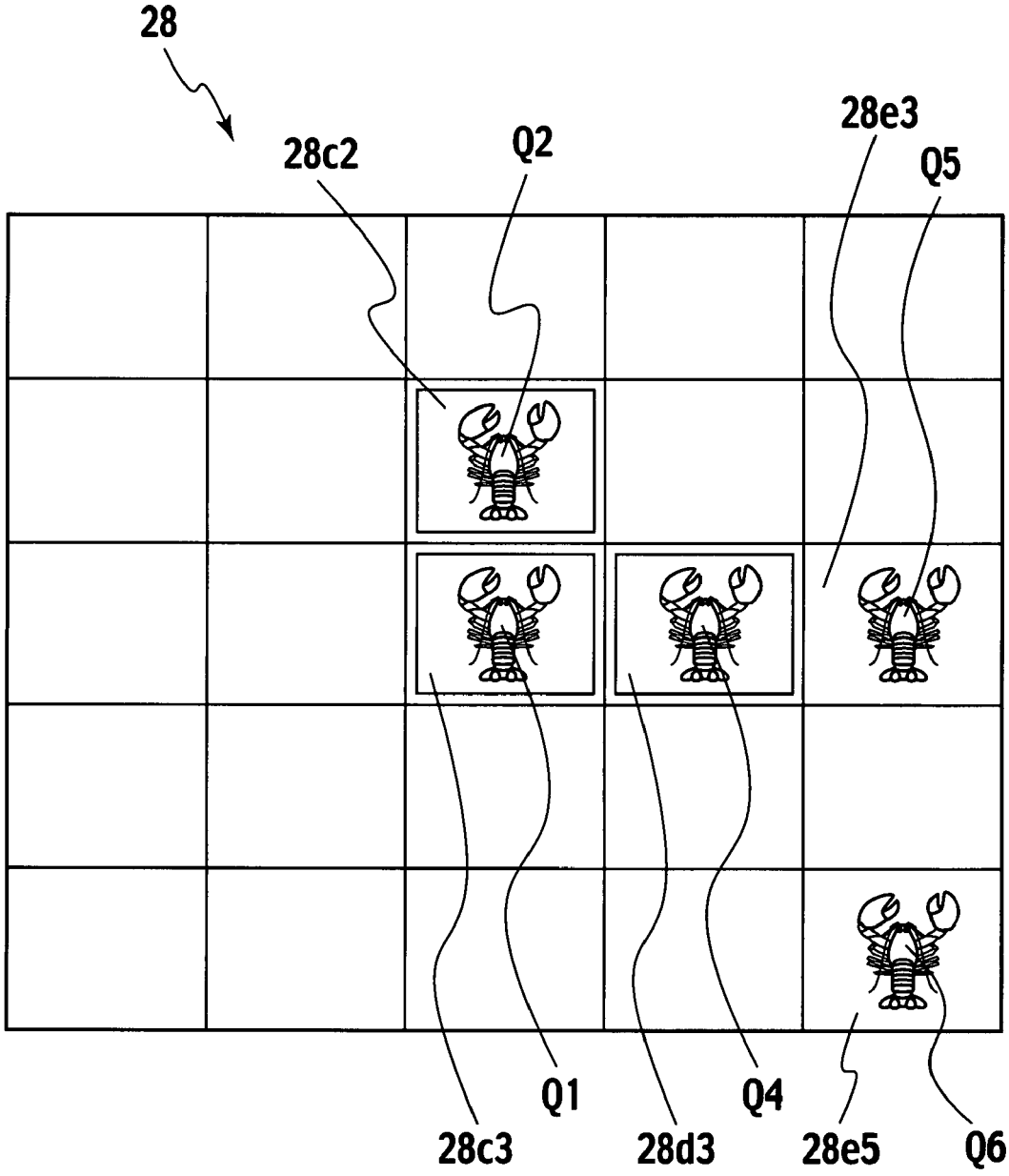
FIG. 20 is a diagram showing one example of symbols to be fixed or rearranged in the slot machine according to the first embodiment of the present invention.
Figure 21:
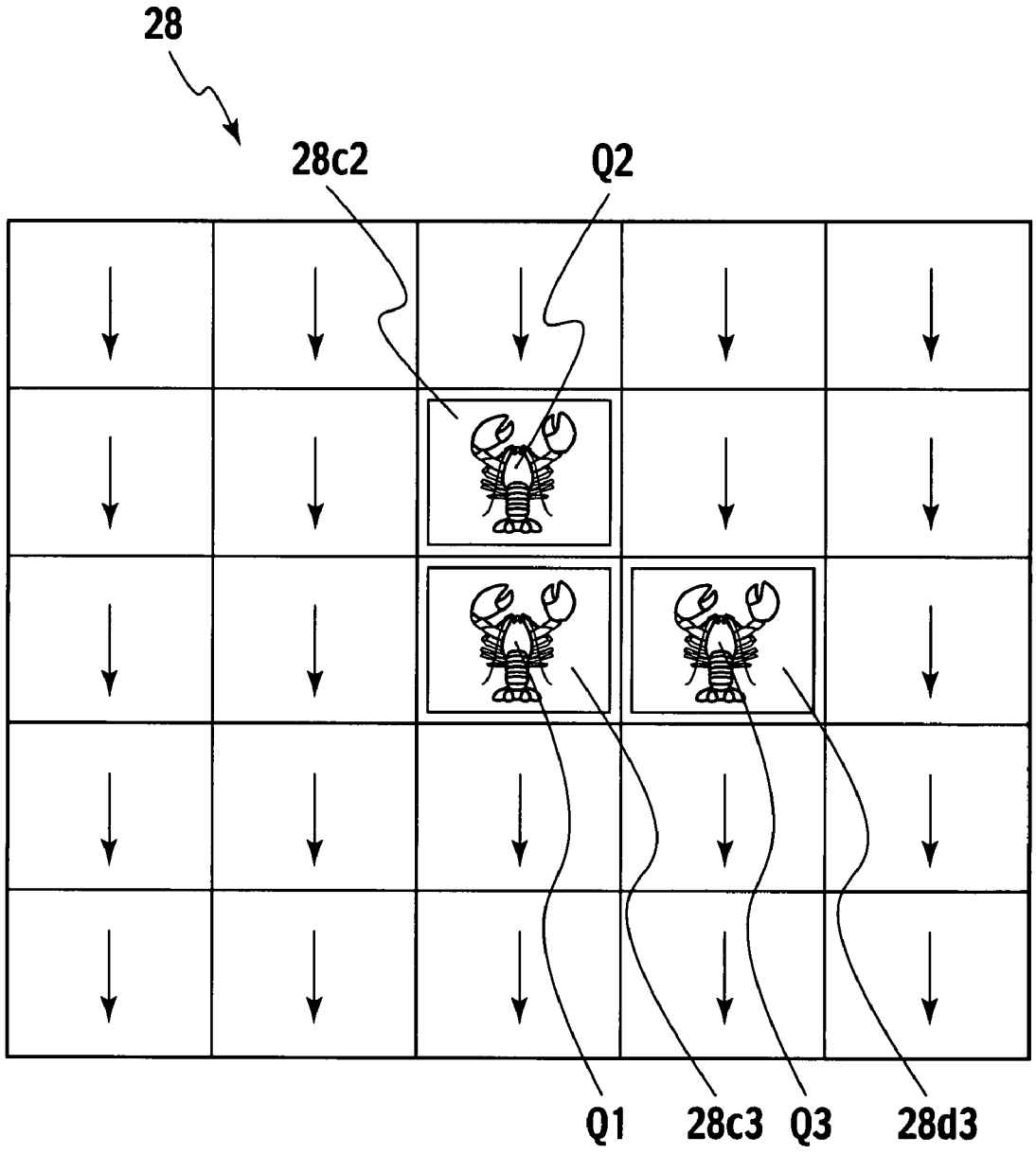
FIG. 21 is a diagram showing one example of symbols to be fixed or scrolled in the slot machine according to the first embodiment of the present invention.

At the step S39, the main CPU 41 judges whether a condition that a value of m is "10" or more is satisfied or not, and terminates the holding game execution processing in the case where this condition is satisfied, or returns to the step S29 in the case where this condition is not satisfied so as to start the n-th holding game. For example, in the case where symbols Q1 and Q2 are fixed and symbols "LOBSTER" are stopped in the display regions 28*d*3, 28*e*3 and 28*e*5 as shown in FIG. 19 when the first holding game is finished, a symbol Q4 which is next to the fixed symbol (that is, symbols fixed by the first holding game) Q1 or Q2 from any of up, down, left and right directions and which coincides with the fixed symbol Q1 or Q2 will be fixed at the step S29 in the second holding game, as shown in FIG. 20. Consequently, more and more symbols will be fixed in chain reaction. Symbols Q5 and Q6 are coinciding with the fixed symbols Q1 and Q2 but they are not next to them from any of up, down, left and right directions so that they will not be fixed. Consequently, at the step S31, symbols other than the symbols Q1, Q2 and Q3 will be scrolled as shown in FIG. 21. In other words, among symbols stopped by the first holding game, symbols other than the fixed symbol Q3 will be scrolled.

According to the holding game execution processing, the following processing is carried out in the first holding game and the second and subsequent holding games.

Namely, in the first holding game, a symbol selected by the pressing operation (that is, the selection operation) of the touch panel 69 and symbols which are next to the symbol selected by the pressing operation of the touch panel 69 from any of up, down, left and right directions and which coincide with the symbol selected by the pressing operation of the touch panel 69 will be fixed among symbols stopped by the base game (see step S28 to step S30). After that, symbols other than the fixed symbols among symbols stopped by the base game are scrolled (see step S31) and then automatically stopped (see step S33).

In the second and subsequent holding games, symbols fixed by the previous holding game and symbols which are next to the symbol fixed by the previous holding game from any of up, down, left and right directions and which coincide with the symbol fixed by the previous holding game among symbols stopped by the previous holding game will be fixed (see step S29). After that, symbols other than the fixed symbols among symbols stopped by the previous holding game are scrolled (see step S31) and then automatically stopped (see step S33).

As described above, in the first embodiment, the slot machine 10 fixes symbols which are next to the symbol selected by the player from any of up, down, left and right directions and which coincide with the symbol selected by the player, so that when the player selects a symbol, there arises a strategic aspect as to which symbol should be selected in order to fix as many symbols as possible. Consequently, the slot machine 10 can arouse the player's interests into the holding games, so that it is possible to improve the entertainment quality of the slot machine 10.

In addition, the slot machine 10 provides the holding games in the case where a payout of coins is not made in the base game, so that it is possible to maintain the player's interests into the games even when a payout of coins is not made in the base game.

In addition, the slot machine 10 can fix more and more symbols in chain reaction as the holding games progress, so that it is possible to raise the strategic aspect even higher.

Second Embodiment

Figure 22:
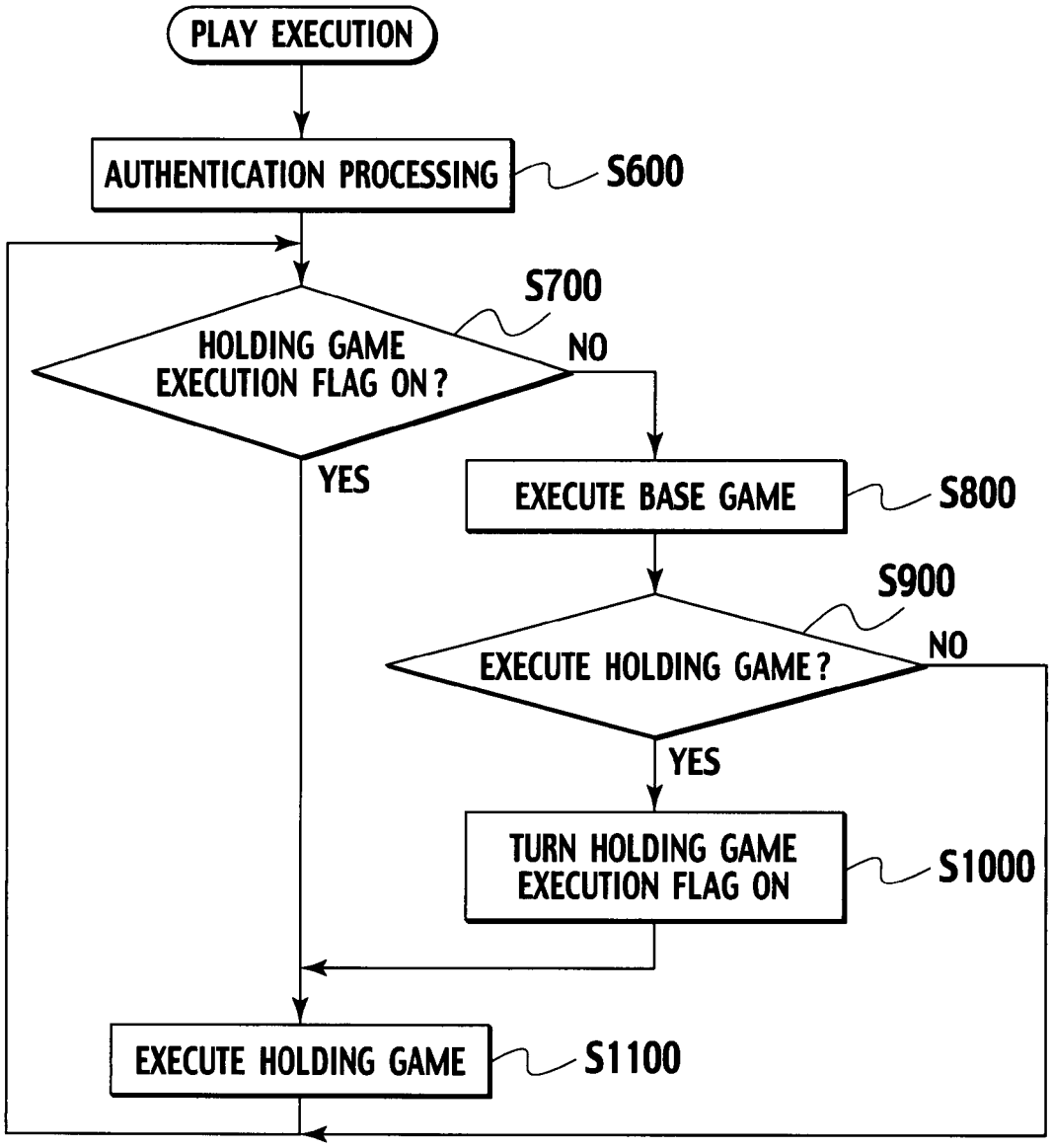
FIG. 22 is a flow chart showing a playing method of the slot machine according to the second embodiment of the present invention.

Next, the second embodiment of the present invention will be described. Here, only the differences between the first embodiment and the second embodiment will be described. First, the outline of the processing to be executed in the second embodiment will be described according to FIG. 22. At the step S600, the slot machine 10 according to the second embodiment of the present invention carries out the authentication processing. The content of the authentication processing is the same as that of the step S100 described above.

At the step 700, the slot machine 10 judges whether a condition that a holding game execution flag (this flag is formed in the RAM 43, and its initial value is "OFF") is ON is satisfied or not, and proceeds to the step S1100 in the case where this condition is satisfied, or proceeds to the step S800 in the case where this condition is not satisfied.

At the step S800, the slot machine 10 executes the base game.

At the step S900, the slot machine 10 determines whether or not to execute the holding game, and proceeds to the step S1000 in the case where it is determined to execute the holding game, or returns to the step S700 in the case where it is determined not to execute the holding game.

At the step S1000, the slot machine 10 turns the holding game execution flag ON.

At the step S1100, the slot machine 10 executes the holding game.

Figure 23:
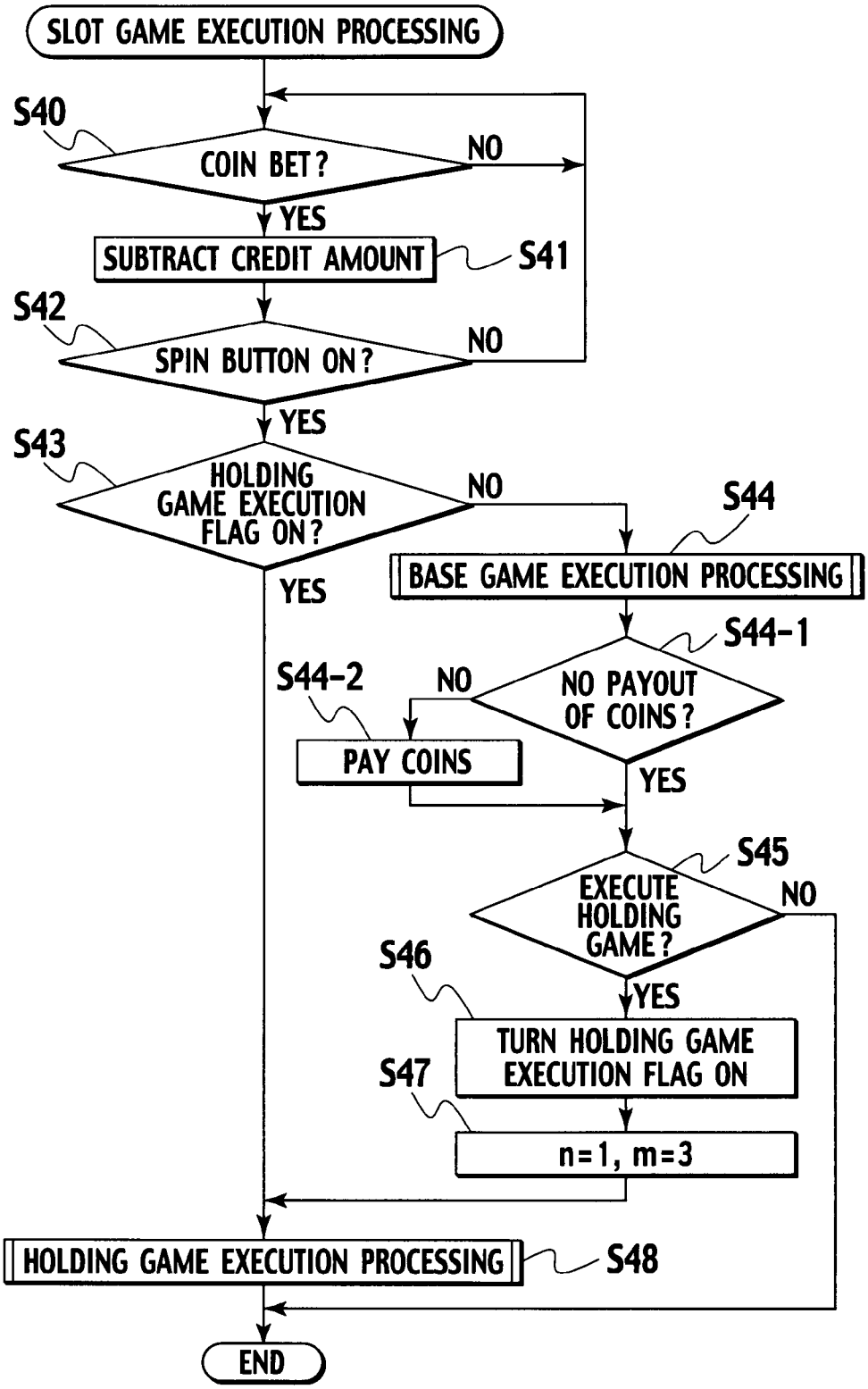
FIG. 23 is a flow chart showing a procedure of a slot game execution processing to be executed by a slot machine according to a second embodiment of the present invention.

FIG. 23 is a flow chart showing the slot game execution processing. The processings of the step S40 to the step S42 are the same as those of the step S11 to the step S13 shown in FIG. 8.

At the step S43, the main CPU 41 judges whether a condition that the holding game execution flag is ON is satisfied or not, and proceeds to the step S48 in the case where this condition is satisfied, or proceeds to the step S44 in the case where this condition is not satisfied.

At the step S44, the main CPU 41 executes the base game execution processing shown in FIG. 9.

The processings of the step S44-1 and the step S44-2 are the same as the processings of the step S15 and the step S18 shown in FIG. 8. Here, however, even after the processing of the step S44-2 is finished, the processing of the step S45, that is a processing to determine whether or not to execute the holding game, will be carried out.

At the step S45, the main CPU 41 determines whether or not to execute the holding game. More specific processing is the same as the step S16. The main CPU 41 proceeds to the step S46 in the case where it is determined to execute the holding game, or terminates the slot game execution processing in the case where it is determined not to execute the holding game.

At the step S46, the main CPU 41 turns the holding game execution flag ON.

At the step S47, the main CPU 41 sets the number n of times for which the holding game has been executed as "1", and sets the number m of symbols to be stopped as "3".

At the step S48, the main CPU 41 executes the holding game execution processing shown in FIG. 24.

FIG. 24 is a flow chart showing the holding game execution processing. At the step S49, the main CPU 41 judges whether a condition that a value of the number n of times for which the holding game has been executed is "1" is satisfied or not, and proceeds to the step S50 in the case where this condition is satisfied, or proceeds to the step S54 in the case where this condition is not satisfied.

The processings of the step S50 to the step S62 are the same as the processings of the step S25 to the step S37. The main CPU 41 executes the first holding game by carrying out the processings of the step S50 to the step S58 when n=1, and executes the second and subsequent holding games by carrying out the processings of the step S54 to the step S58 when n is greater than or equal to 2.

At the step S63, the main CPU 41 judges whether a condition that a value of the number n of times for which the holding game has been executed is "6" is satisfied or not, and proceeds to the step S65 in the case where this condition is satisfied, or proceeds to the step S64 in the case where this condition is not satisfied.

At the step S64, the main CPU 41 judges whether a condition that a value of the number m of symbols to be stopped is "10" or more is satisfied or not, and proceeds to the step S65 in the case where this condition is satisfied, or terminates the holding game execution processing in the case where this condition is not satisfied.

At the step S65, the main CPU 41 turns the holding game execution flag OFF. After that, the main CPU 41 terminates the holding game execution processing.

Consequently, even in the second embodiment, the first holding game and the second and subsequent holding games are executed similarly as in the first embodiment, and the contents of these holding games are the same as in the first embodiment. However, in the second embodiment, there is a possibility of having the holding game executed in either one of the case where a payout of coins is made and the case where a payout of coins is not made as a result of the base game (see the step S44-1 to the step S45 shown in FIG. 23). Note however that it becomes necessary for the player to make the coin BET in each holding game (see the step S40 to the step S43 and the step S48 shown in FIG. 23).

As described above, in the second embodiment, the slot machine 10 fixes symbols which are next to the symbol selected by the player from any of up, down, left and right directions and which coincide with the symbol selected by the player, so that when the player selects a symbol, there arises a strategic aspect as to which symbol should be selected in order to fix as many symbols as possible. Consequently, the slot machine 10 can arouse the player's interests into the holding games, so that it is possible to improve the entertainment quality of the slot machine 10.

In addition, the slot machine 10 can fix more and more symbols in chain reaction as the holding games progress, so that it is possible to raise the strategic aspect even higher.

In the above, the embodiments of the slot machine according to the present invention have been described, but they are only showing specific examples, they are not intended to limit the present invention particularly, and the specific configuration of each means or the like can be appropriately changed by design. Also, the effects described in the embodiments of the present invention are only listing the most preferable effects arising from the present invention, and the effects of the present invention are not limited to those described in the embodiments of the present invention.

What is claimed is:

1. A slot machine comprising:

a display that automatically arranges or rearranges a plurality of symbols having different types;

a controller that executes a base game for automatically rearranging the plurality of symbols that are arranged on the display, in a matrix state; and a control input signal switch capable of carrying out a selection operation to select a symbol from among symbols rearranged by the base game;

wherein the controller executes a first holding game for fixing a symbol selected by the selection operation and one or more symbols which are next to the symbol selected by the selection operation and whose type coincides with one type of the symbol selected by the selection operation, and rearranging symbols other than the fixed symbols among the symbols rearranged by the base game, and second and subsequent holding games for fixing symbols fixed by a previous holding game and one or more symbols which are next to the symbols fixed by the previous holding game and whose type coincides with one type of the symbols fixed by the previous holding game among symbols rearranged by the previous holding game, and rearranging symbols other than the fixed symbols among the symbols rearranged by the previous holding game, and wherein all holding games are played as a part of the same play.

2. The slot machine according to claim 1, wherein the controller judges whether or not to make a payout of credits according to symbols rearranged by the base game, and in a case where it is judged that a payout of credits is not to be made, the controller executes the first holding game and the second and subsequent holding games.

3. A slot machine comprising:

a display that automatically arranges or rearranges a plurality of symbols having different types;

a controller that executes a base game for automatically rearranging the plurality of symbols that are arranged on the display, in a matrix state; and a control input signal switch capable of carrying out a selection operation to select a symbol from among symbols rearranged by the base game;

wherein the controller judges whether or not to make a payout of credits according to symbols rearranged by the base game, and in a case where it is judged that a payout of credits is not to be made, the controller executes a first holding game for fixing a symbol selected by the selection operation and one or more symbols which are next to the symbol selected by the selection operation and whose type coincides with one type of the symbol selected by the selection operation, and rearranging symbols other than the fixed symbols among the symbols rearranged by the base game, and second and subsequent holding games for fixing symbols fixed by a previous holding game and one or more symbols which are next to the symbols fixed by the previous holding game and whose type coincides with one type of the symbols fixed by the previous holding game among symbols rearranged by the previous holding game, and rearranging symbols other than the fixed symbols among the symbols rearranged by the previous holding game, and wherein all holding games are played as part of the same play.

4. A playing method of a slot machine, comprising the steps of:

executing a base game for automatically rearranging a plurality of symbols having different types that are arranged on a display, in a matrix state;

executing a first holding game for fixing a symbol selected by a selection operation using a control input signal switch capable of carrying out a selection operation to select a symbol from among symbols rearranged by the base game, and one or more symbols which are next to the symbol selected by the selection operation and whose type coincides with one type of the symbol selected by the selection operation, and rearranging symbols other than the fixed symbols among the symbols rearranged by the base game; and executing second and subsequent holding games for fixing symbols fixed by a previous holding game and one or more symbols which are next to the symbols fixed by the previous holding game and whose type coincides with one type of the symbols fixed by the previous holding game among symbols rearranged by the previous holding game, and rearranging symbols other than the fixed symbols among the symbols rearranged by the previous holding game, and wherein all holding games are played as part of the same play.

5. The playing method of a slot machine according to claim 4, wherein whether or not to make a payout of credits according to symbols rearranged by the base game is judged, and in a case where it is judged that a payout of credits is not to be made, the first holding game and second and subsequent holding games are executed.

6. A playing method of a slot machine, comprising the steps of:

executing a base game for automatically rearranging a plurality of symbols having different types that are arranged on a display, in a matrix state;

judging whether or not to make a payout of credits according to symbols rearranged by the base game, and in a case where it is judged that a payout of credits is not to be made, executing a first holding game for fixing a symbol selected by a selection operation using a control input signal switch capable of carrying out a selection operation to select a symbol from among symbols rearranged by the base game, and one or more symbols which are next to the symbol selected by the selection operation and whose type coincides with one type of the symbol selected by the selection operation, and rearranging symbols other than the fixed symbols among the symbols rearranged by the base game; and executing second and subsequent holding games for fixing symbols fixed by a previous holding game and one or more symbols which are next to the symbols fixed by the previous holding game and whose type coincides with one type of the symbols fixed by the previous holding game among symbols rearranged by the previous holding game, and rearranging symbols other than the fixed symbols among the symbols rearranged by the previous holding game, and wherein all holding games are played as part of the same play.

7. A slot machine comprising a controller that executes a base game for automatically rearranging a plurality of symbols having different types that are arranged on a display, in a matrix state, and executes a first holding game for fixing a symbol selected by a selection operation using a control input signal switch capable of carrying out a selection operation to select a symbol from among symbols rearranged by the base game, and one or more symbols which are next to the symbol selected by the selection operation and whose type coincides with one type of the symbol selected by the selection operation, and rearranging symbols other than the fixed symbols among the symbols rearranged by the base game, and second and subsequent holding games for fixing symbols fixed by a previous holding game and one or more symbols which are next to the symbols fixed by the previous holding game and whose type coincides with one type of the symbols fixed by the previous holding game among symbols rearranged by the previous holding game, and rearranging symbols other than the fixed symbols among the symbols rearranged by the previous holding game, wherein all the holding games are played as part of the same play.

* * * * *